US005404661A

United States Patent [19]

Sahm et al.

[11] Patent Number: 5,404,661

[45] Date of Patent: Apr. 11, 1995

[54] METHOD AND APPARATUS FOR DETERMINING THE LOCATION OF A WORK IMPLEMENT

[75] Inventors: William C. Sahm, Peoria; Adam J. Gudat, Edelstein; Daniel E. Henderson, Washington, all of Ill.

[73] Assignee: Caterpillar Inc., Peoria, Ill.

[21] Appl. No.: 240,348

[22] Filed: May 10, 1994

[51] Int. Cl.[6] ..... E21B 21/06

[52] U.S. Cl. ..... 37/348; 37/347; 37/905; 364/424.07

[58] Field of Search ..... 342/25, 149, 174, 191, 342/357; 364/DIG. 1, 232.9, 230.2, 424, 458, 424.07; 37/348, 349, 103, 905; 111/903, 904; 172/4.5, 7

[56] References Cited

U.S. PATENT DOCUMENTS

| | | | |
|---|---|---|---|
| 4,244,123 | 11/1981 | Lazure et al. | 37/348 |
| 4,630,685 | 12/1986 | Huck, Jr. et al. | 172/7 |
| 4,677,555 | 6/1987 | Goyet | 37/348 X |
| 4,776,750 | 10/1988 | Griswold, Jr. et al. | 37/348 X |
| 4,812,991 | 3/1989 | Hatch | 364/458 |
| 4,888,890 | 12/1989 | Studebaker et al. | 37/348 |
| 4,912,643 | 3/1990 | Beirxe | 37/348 X |
| 4,963,889 | 10/1990 | Hatch | 342/357 |
| 5,065,326 | 11/1991 | Sahm | 364/424.07 |

OTHER PUBLICATIONS

Article entitled "Artificial intelligence in the control and operation of construction plant–the autonomous robot excavator" published 1993.

Article entitled "Automation and Robotics in Construction"–vol. 1 by FHG (9 pgs.) believed to have been published on or about Jun. 1991.

Article entitled "Backhoe Monitor" by IHC–3 Pgs.–Publication date unknown but believed to be prior to one year before the filing date.

*Primary Examiner*—Dennis L. Taylor
*Assistant Examiner*—Robert Pezzuto
*Attorney, Agent, or Firm*—Steven R. Janda

[57] ABSTRACT

An apparatus for determining the location of a work implement at a work site is provided. The apparatus includes an undercarriage, a car body rotatably connected to the undercarriage, a boom connected to the car body, a stick connected to the boom, a work implement connected to the stick, and a positioning system including a receiver connected to the stick and a processor for determining the location of the receiver in three dimensional space at a plurality of points as the car body is rotated and for determining the location and orientation of the work implement.

34 Claims, 27 Drawing Sheets

METHOD AND APPARATUS FOR DETERMINING THE LOCATION OF A WORK IMPLEMENT

TECHNICAL FIELD

The invention relates generally to control of work machines, and more particularly, to a method and apparatus for determining the location and orientation of a work implement in response to an external reference.

BACKGROUND ART

Work machines such as mining shovels and the like are used for excavation work. These excavating machines have work implements which consist of a boom, a stick and a bucket. The stick and bucket are controlably actuated by a set of cables and gear drives. In the drawing shown in FIG. 1, a mining shovel 102 is shown in which the boom 104 remains in a substantially fixed position with respect to the car body 106, the bucket 108 is fixed to the stick 110, and the stick 110 is movable with respect to the boom 104 in response to hoist cables 112 and a gear drive included in a yoke 114. An operator typically manipulates the work implement to perform a sequence of distinct functions which constitute a complete excavation work cycle.

Prior art monitoring and control systems for linkage type machines require multiple sensors to determine the orientation and configuration of the implement linkage or bucket. Linkage sensors such as yo-yo devices and rotary sensors mounted on linkage members moving relative to each other, in general, have not proved to have long life. Also, if not only linkage orientation and configuration with respect to the work machine is required but also position and orientation of the work machine itself within the work site, then separate sensors and systems are required to provide the additional information.

For purposes of understanding the invention, it is important to understand the following typical characteristics of large mining shovels 102: a) The end of the stick 110 furthest away from the bucket 108 does not pass through the boom 104; b) By moving the stick 110 in or out fully, it is easy to position the linkage so there is a known distance between the end of the stick 110 and the center of rotation of the stick yoke 114; and c) The shovel undercarriage 116 will not move when the operator is digging since the same power supply cannot be used for travel and digging simultaneously.

In mining operations, the current practice of delineating ore from waste material or geographic boundaries such as between adjacent properties is by use of flags, stakes, or paint stripes on the material to provide a visual reference to the operator. This practice is less than ideal because flags, stakes, and paint stripes can all be moved or destroyed during normal mining operations plus they may be difficult to see at night.

Ramifications of an operator not following the flagged or staked setup plan can include sending waste material instead of ore to processing, sending ore to be disposed instead of waste material, and/or incorrectly identifying the property from which a load of ore was obtained.

The present invention is directed to overcoming one or more of the problems set forth above.

DISCLOSURE OF THE INVENTION

In one aspect of the invention, an apparatus for determining the location of a work implement at a work site is provided. The apparatus includes an undercarriage, a car body rotatably connected to the undercarriage, a boom connected to the car body, a stick connected to the boom, a work implement connected to the stick, and a positioning system including a receiver connected to the stick and a processor for determining the location of the receiver in three dimensional space at a plurality of points as the car body is rotated and for determining the location and orientation of the work implement.

In a second aspect of the invention, a method is provided for determining the location of a mining shovel at a work site, the mining shovel including an undercarriage, a car body rotatably connected to the undercarriage, a boom connected to the car body, a stick connected to the boom, and a work implement connected to the stick. The method includes the steps of rotating the car body, receiving signals from an external reference source, determining the position of a point on the stick in response to the received signals, determining the location of the point on the stick in three dimensional space at a plurality of points as said car body is rotated, and determining the location and orientation of the work implement in response to the location of the plurality of points.

The invention also includes other features and advantages that will become apparent from a more detailed study of the drawings and specification.

BRIEF DESCRIPTION OF THE DRAWINGS

For a better understanding of the invention, reference may be made to the accompanying drawings, in which.

BEST MODE FOR CARRYING OUT THE INVENTION

Figure 1:
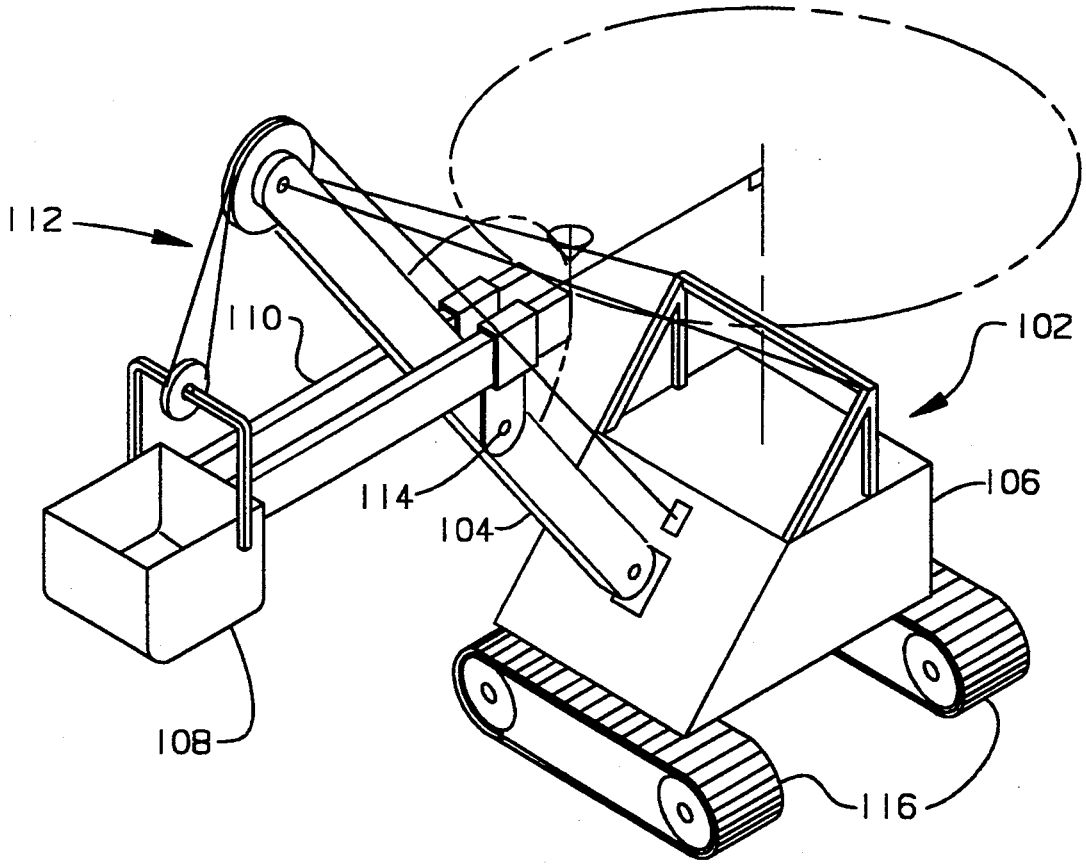
FIG. 1 is a diagrammatic illustration of a cable mining shovel.
Figure 2:
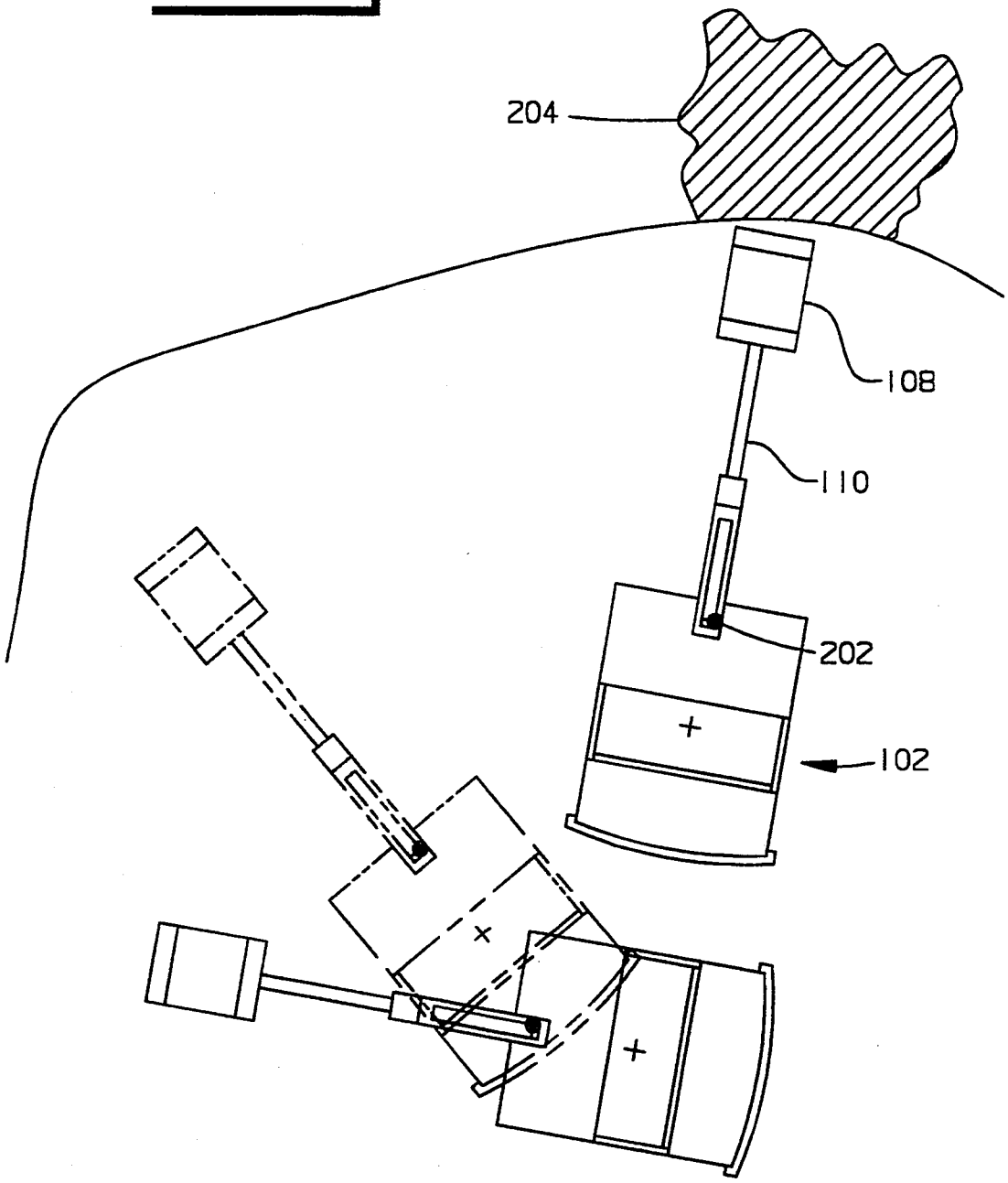
FIG. 2 is a schematic illustration of a mining shovel operating in a work site.

A mining shovel 102 is shown schematically in FIG. 2 with a receiver 202 for a three dimensional positioning system connected to the stick 110. In the mining shovel of FIG. 1, the stick 110 is shown to include box frames extending through the yoke 114 on both sides of the boom 104. In this embodiment, the receiver 202 is laterally displaced from a centerline of the stick extending through said stick in a plane that is substantially perpendicular to the plane of rotation of the car body 106. In an alternative embodiment, the stick 110 extends through the center of the boom 104 and the receiver 202 is located on or near the centerline of the stick 110.

The receiver 202 is advantageously connected to the stick 110 such that the antenna orientation does not change as the stick pivots with respect to the boom. Without such compensation for changes in orientation of the stick, the field of view of the receiver 202 would change as the stick 110 pivots about the boom 104 so that at some stick positions, the receiver 202 would be unable to receive signals from satellites in some portions of the sky.

In the preferred embodiment, the receiver mounting is a pendulum type mounting including a pivot with the receiver 202 being elevationally above the pivot and a heavy weight (not shown) located elevationally below the pivot. The weight and pivot maintain the receiver 202 in substantially the same orientation even though the stick to which it is mounted pivots about the boom 104. A small portion of the sky is still obscured if the car body 106 is canted from the horizontal in the transverse direction. However, in most operations this effect is insignificant. To correct any error caused by this effect, a more complex arrangement is included, such as a bracket extending from the stick with a ballsocket arrangement having the receiver 202 connected to the ball above the socket and the heavy weight connected to the ball below the socket. In this way, the weight prevents the orientation of the receiver 202 from being changed along any axis when the machine is within most normal ranges of operation. Other, more complex arrangments to maintain the orientation of the receiver 202 are also suitable for use in connection with the invention without deviating from its scope.

FIG. 2 diagrammatically illustrates operation of the mining shovel 102 at a work site. The target area 204 represents the material to be excavated by the mining shovel 102 and may be ore, overburden, or a combination of ore and overburden. In typical operation, the machine operator manipulates the controls for the undercarriage 116 to position the mining shovel 102 near the target area 204. Once in position, the operator controls the swing, hoist, and crowd controls to excavate material from the target area 204 and load haulage trucks that remove the material to a waste pile or an ore processing site.

Figure 3A:
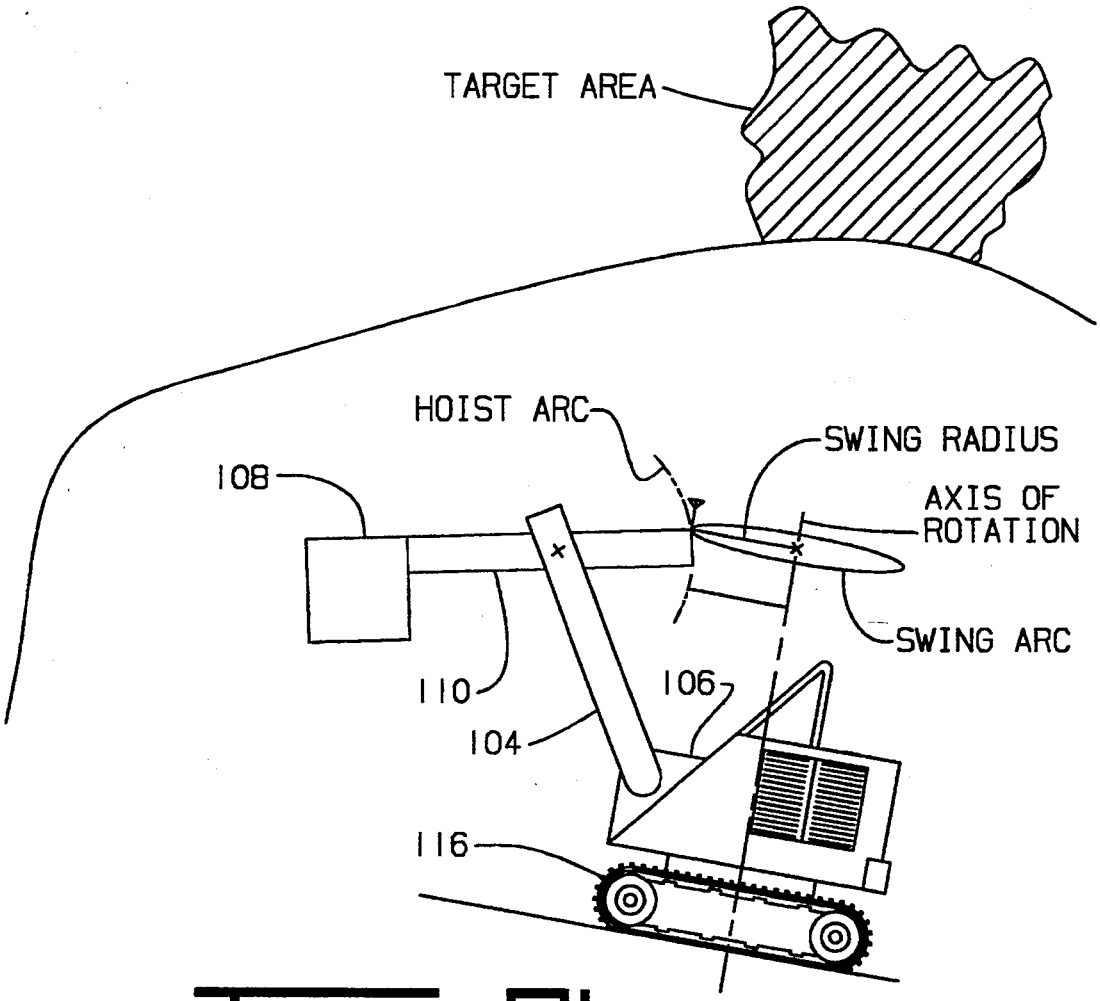
FIG. 3 is a schematic illustration of a mining shovel operating in a work site.
Figure 3B:
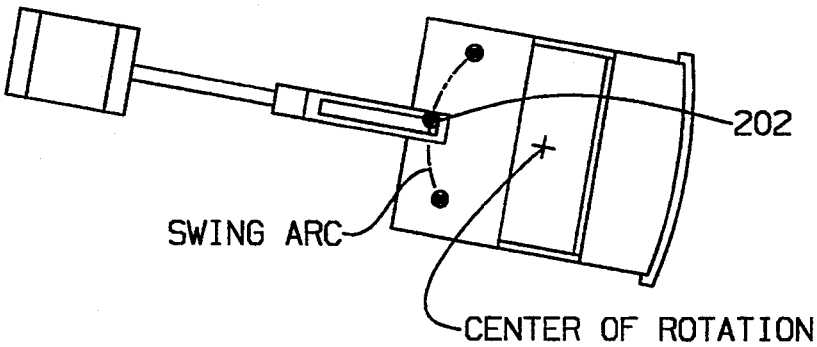

As shown in FIG. 3, the swing controls cause the car body 106 to rotate about an axis of rotation such that the receiver 202 travels through a swing arc. The hoist control causes the hoist cables 112 to rotate the stick about the yoke pivot of rotation such that the receiver traces a hoist arc. The crowd control causes the stick extend and retract through the yoke 114. Note that as the stick is extended or retracted, the swing arc and the hoist arc move with respect to the axis of rotation and also have different radii.

Figure 4:
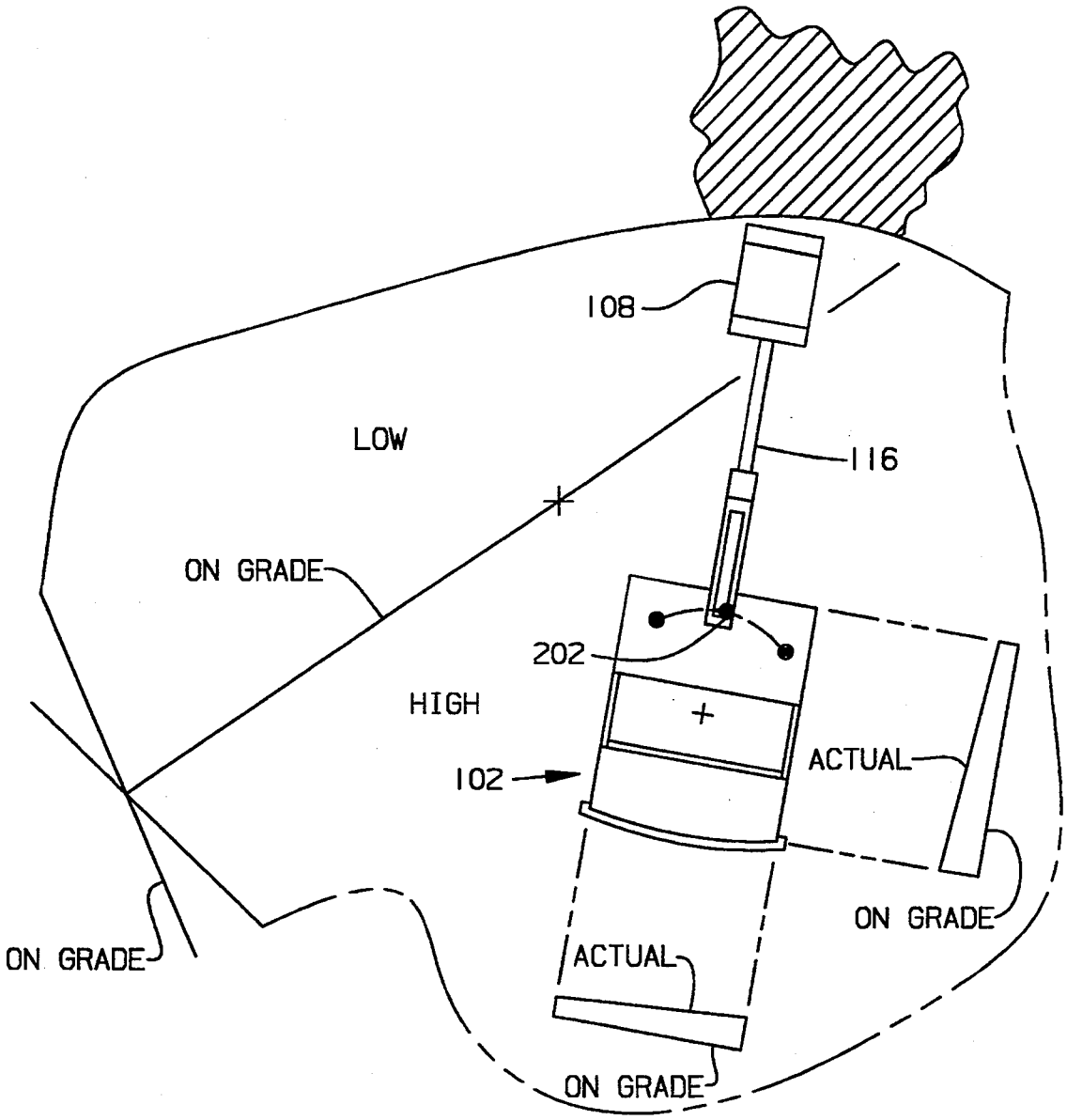
FIG. 4 is a schematic illustration of a mining shovel operating on a work bench.

FIG. 4 illustrates the slope of the work surface, known in the art as a bench. Mine managers develop plans for excavating ore and overburden that include bench elevation and slope. In operation, however, the actual elevation and slope of the bench may differ from plan. This can result in excavation of the wrong material or a lack of correct information being provided to mine managers and planners. To solve this problem in the prior art, surveys of the bench are made and either the mining shovel or other support machines, such as track-type tractors or wheel loaders, are used to groom the bench to the proper slope and elevation.

Figure 5A:
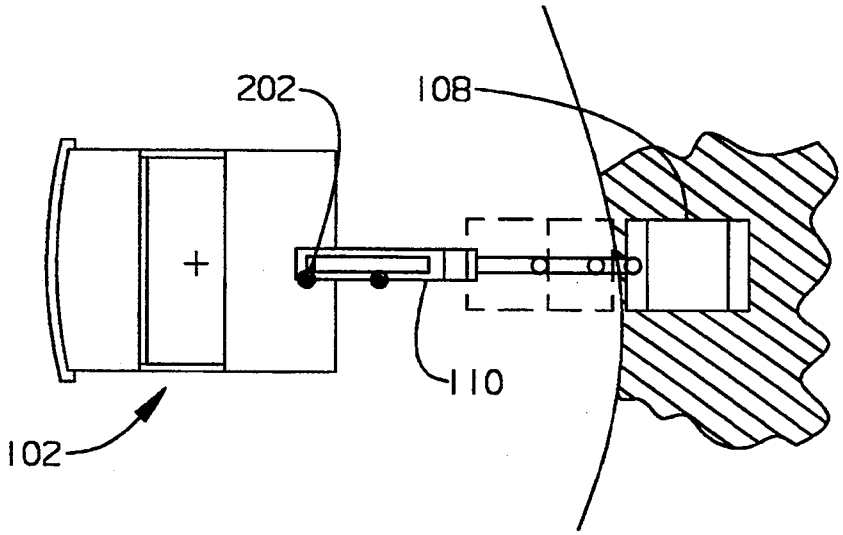
FIG. 5 is a schematic illustration of a mining shovel operating in a work site.
Figure 5B:
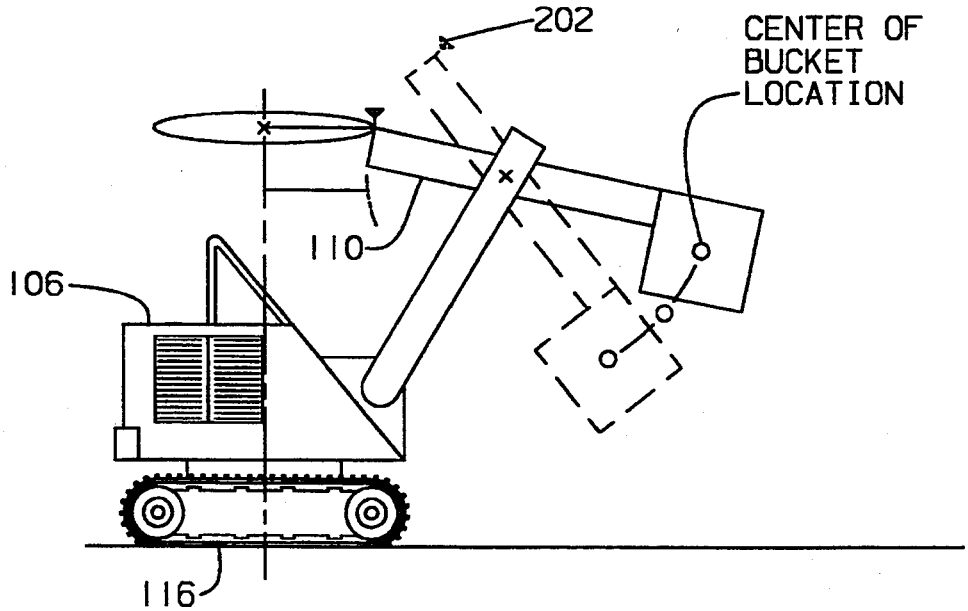

FIG. 5 shows the mining shovel 102 excavating material from the target area 204. In most digging operations by mining shovels, the center of the bucket travels substantially more in the vertical direction with respect to the car body than in the horizontal direction.

It should also be understood that mining shovels exert substantially more energy when the machine is excavating material than when the bucket and linkage are not engaged with material. This allows an on-board system to sense when the mining shovel is digging by sensing the power being expended by the hoist and crowd devices.

Figure 6:
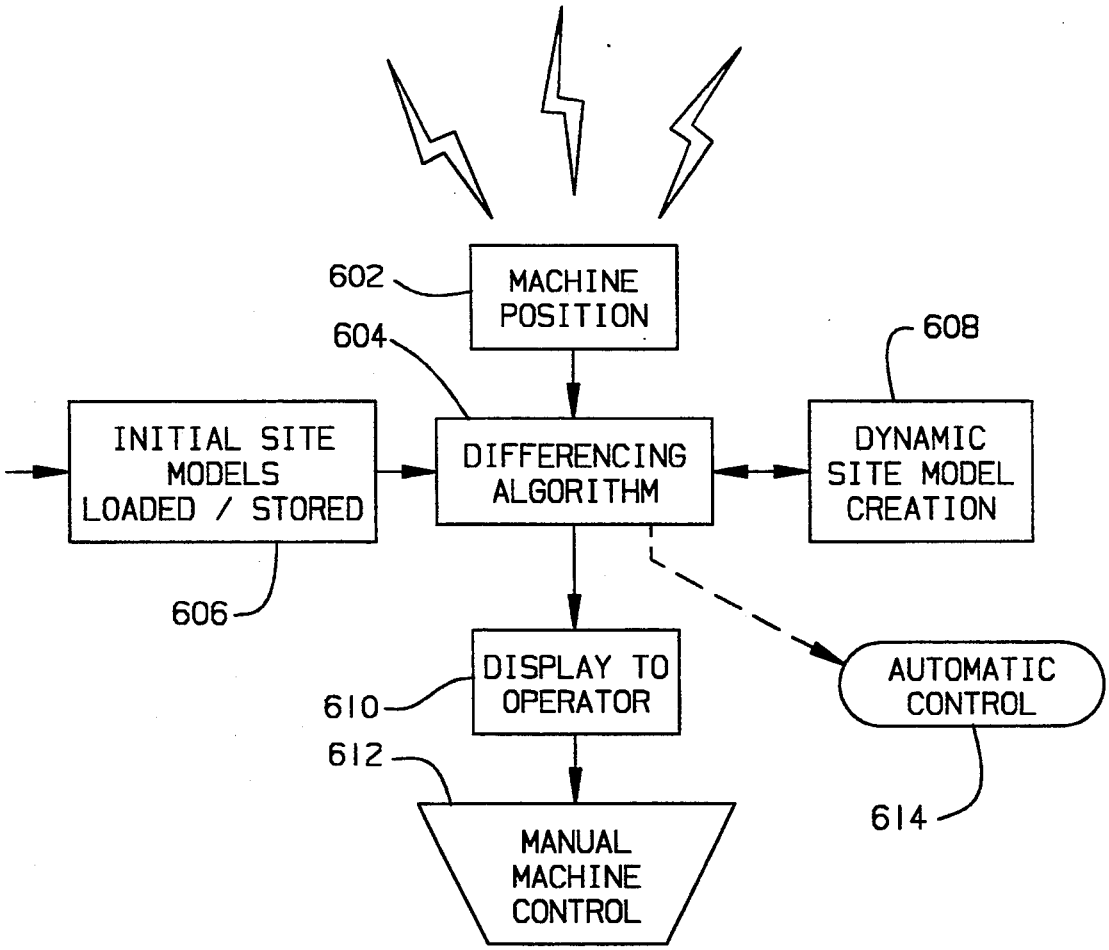
FIG. 6 is a block diagram describing the interrelated system.

Turning now to FIG. 6, the method of the present invention is shown schematically. Using a known three-dimensional positioning system with an external reference, for example (but not limited to) 3-D laser, GPS, GPS/laser combinations, radio triangulation, microwave, or radar, receiver 202 position coordinates are determined in block 602 as the machine operates within the work site. These coordinates are instantaneously supplied as a series of discrete points to a differencing algorithm at 604. The differencing algorithm calculates the receiver position and path in real time. Digitized models of the actual and desired site geographies are loaded or stored at block 606, an accessible digital storage and retrieval facility, for example a local digital computer. The differencing algorithm 604 retrieves, manipulates and updates the site models from 606 and generates at 608 a dynamic site database of the difference between the actual site and the desired site model, updating the actual site model in real-time as new position information is received from block 602. This dynamically updated site model is then made available to the operator in display step 610, providing real time position and site geography/topography updates in human readable form. Using the information from the display the operator can efficiently monitor and direct the manual control of the machine at 612.

Additionally, or alternately, the dynamic update information can be provided to an automatic machine control system at 614. The controls can provide an operator assist to minimize machine work and limit the manual controls if the operator's proposed action would, for example, overload the machine. Alternately, the site update information from the dynamic database can be used to provide fully automatic machine/tool control.

Figure 7:
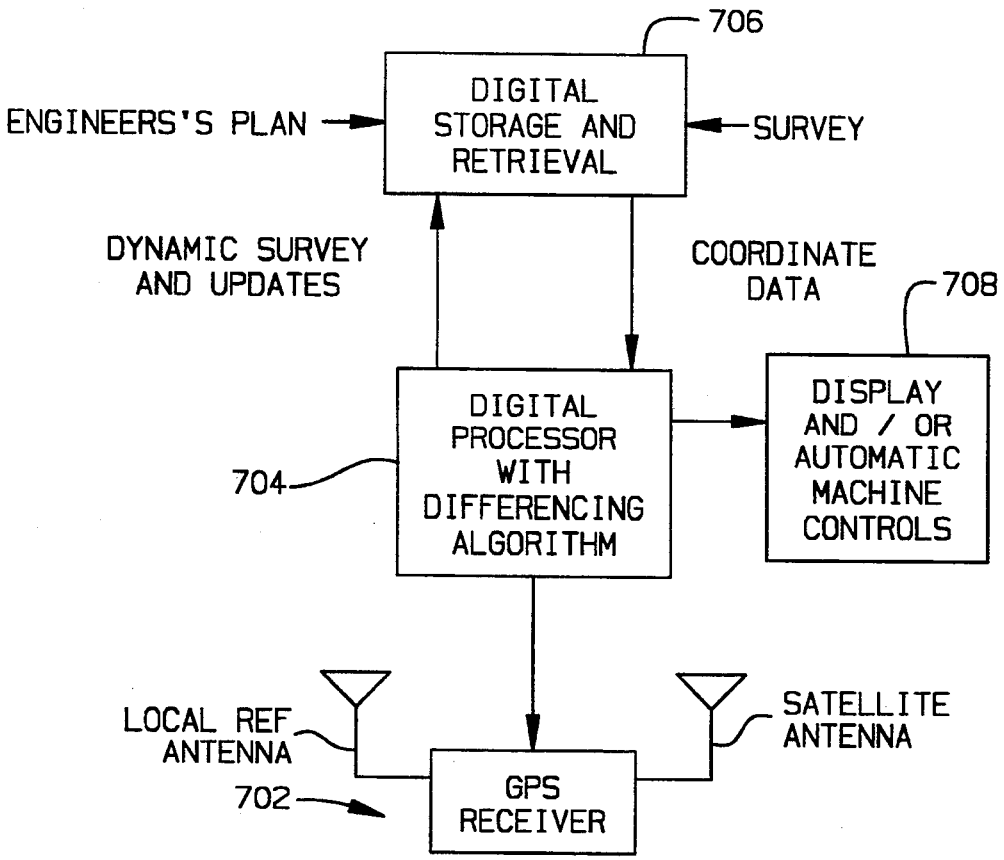
FIG. 7 is a block diagram describing the interrelated system.

Referring now to FIG. 7, an apparatus which can be used in connection with the receipt and processing of GPS signals to carry out the present invention is shown in block diagram form comprising a GPS receiver apparatus 702 with a local reference antenna and a satellite antenna; a digital processor 704 employing a differencing algorithm, and connected to receive position signals from 702; a digital storage and retrieval facility 706 accessed and updated by processor 704, and an operator display and/or automatic machine controls at 708 receiving signals from processor 704.

GPS receiver system 702 includes a satellite antenna receiving signals from global positioning satellites, and a local reference antenna. The GPS receiver system 702 uses position signals from the satellite antenna and differential correction signals from the local reference antenna to generate position coordinate data in three-dimensions to centimeter accuracy for moving objects. Alternatively, raw data from the reference antenna can be processed by the system to determine the coordinate data.

This position information is supplied to digital processor 704 on a real-time basis as the coordinate sampling rate of the GPS receiver 702 permits. The digital storage facility 706 stores a first site model of the desired excavation, for example according to a mining engineer's plan, and a second digitized site model of the actual site geography, for example as initially surveyed. The site model corresponding to the actual site geography can be accessed and updated in real time by digital processor 704 as it receives new position information from GPS receiver 702.

Digital processor 704 further generates signals representing the difference between the continuously-updated actual site model and the mining engineer's plan. These signals are provided to the operator display and/or automatic machine controls at 708 to direct the operation of the machine over the site to bring the updated actual site model into conformity with the plan. The operator display 708, for example, provides one or more visual representations of the difference between the actual, continuously-updated site model and the desired site model or ore locations to guide the operator in excavating the desired material and in directing loaded trucks to deliver the loads to either an overburden pile or to the ore processor.

Figure 8:
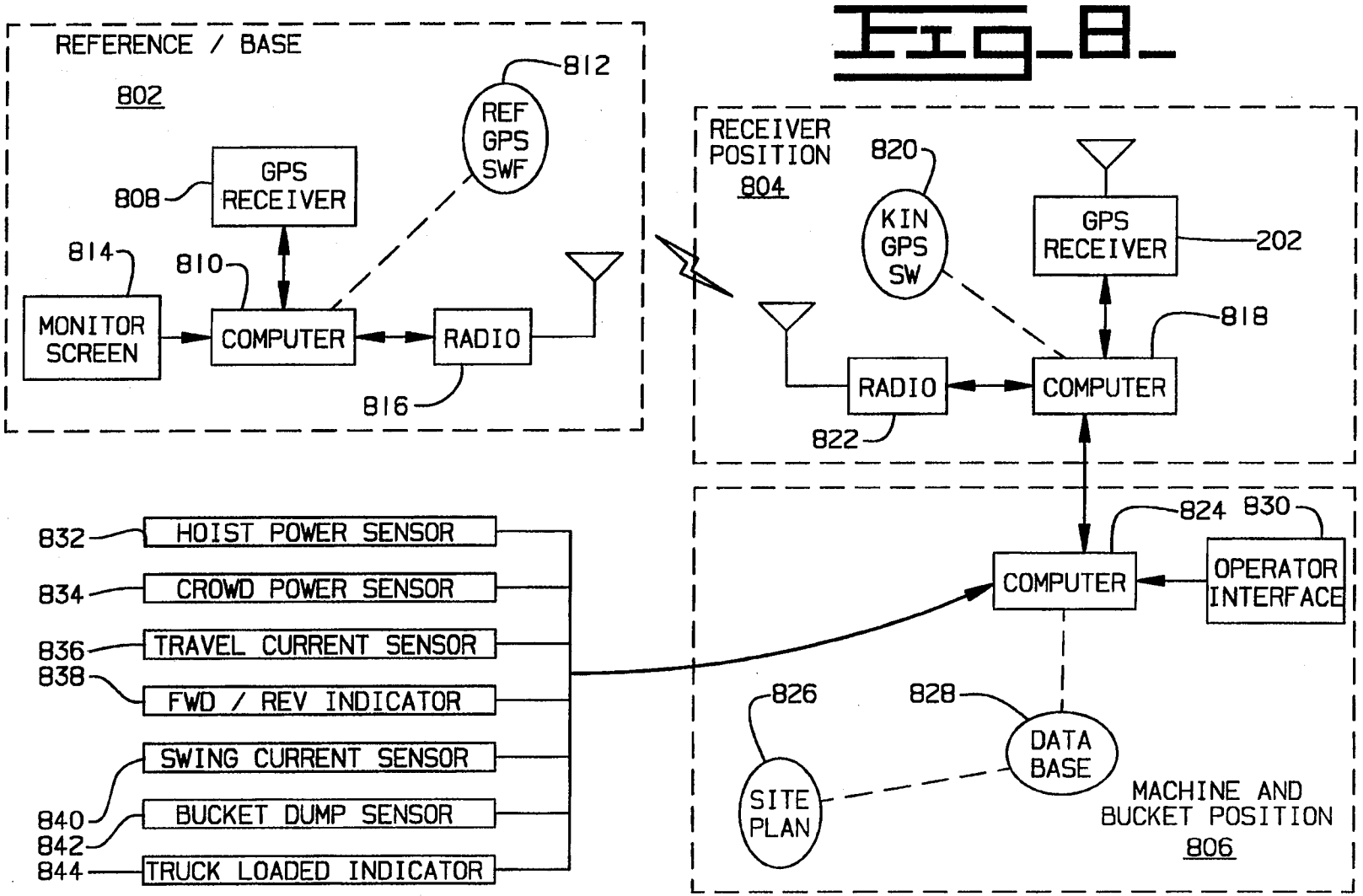
FIG. 8 is a block diagram describing the interrelated system.

Referring now to FIG. 8, a more detailed schematic of a system according to FIG. 7 is shown using kinematic GPS for position reference signals. A base reference module 802 and a position module 804 together determine the three-dimensional coordinates of the receiver 202 relative to the site, while an update/control module 806 converts this position information into real time representations of the machine, bucket, and work site which can be used to accurately monitor and control the machine.

Base reference module 802 includes a stationary GPS receiver 808; a computer 810 receiving input from receiver 808; reference receiver GPS software 812, temporarily or permanently stored in the computer 810; a standard computer monitor screen 814; and a digital transceiver-type radio 816 connected to the computer and capable of transmitting a digital data stream. In the illustrative embodiment base reference receiver 808 is a high accuracy kinematic GPS receiver; computer 810 for example is a 486DX computer with a hard drive, 8 megabyte RAM, two serial communication ports, a printer port, an external monitor port, and an external keyboard port; monitor screen 814 is a passive matrix color LCD or any other suitable display type, such as color VGA; and radio 816 is a commercially available digital data transceiver.

Position module 804 comprises a matching kinematic GPS receiver 202, a matching computer 818 receiving input from receiver 202, kinematic GPS software 820 stored permanently or temporarily in computer 818, and a matching transceiver-type digital radio 822 which receives signals from radio 816 in base reference module 802. In the illustrative embodiment position module 804 is located on the mining shovel to move with it over the work site.

Machine and bucket update/control module 806, also carried on board the machine in the illustrated embodiment, includes an additional computer 824, receiving input from position module 804; one or more digitized site models 826 digitally stored or loaded into the computer memory; a dynamic database update module 828, also stored or loaded into the memory of computer 824; and an operator interface 830 including a color display screen connected to the computer 824. Instead of, or in addition to, operator interface 830, an automatic machine controls can be connected to the computer to receive signals which operate the machine in an autonomous or semi-autonomous manner.

To provide further information regarding operation of the mining shovel 102 to the computer 824, a hoist power sensor 832 is included providing an indication of the amount of power being exerted by the electric motor(s) driving the hoist cables 112. A crowd power sensor 834 is included to provide a signal indicative of the amount of power exerted by the electric motor(s) used to extend and retract the stick 110. A travel current sensor 836 is advantageously a switch for indicating when the undercarriage 116 is being moved by the electric travel motor (not shown). A forward/reverse indicator 838 indicates the direction of travel selected by the operator. A swing current sensor 840 provides a signal to indicate when the swing motor is causing the car body 106 to rotate. A bucket dump sensor 842 is included to indicate when the operator actuates a mechanism to cause the bucket 108 to discharge its load. A truck loaded indicator 844 is advantageously a push button switch located in the operator compartment which the operator depresses when a truck has been completely loaded. In the preferred embodiment, this push button switch also activates a horn to signal the truck operator that the truck is fully loaded and should be driven to the dump site. As is well-known in the art, lights are often included on large mining trucks to indicate to the shovel operator when the truck is fully loaded. The load indicating lights operate in response to the truck payload monitoring system.

Although update/control module 806 is here shown mounted on the mobile machine, some or all portions may be stationed remotely. For example, computer 824, site model(s) 826, and dynamic database 828 could be connected by radio data link to position module 804 and operator interface 830. Position and site update information can then be broadcast to and from the machine for display or use by operators or supervisors both on and off the machine.

Base reference station 802 is fixed at a point of known three-dimensional coordinates relative to the work site. Through receiver 808 base reference station 802 receives position information from a GPS satellite constellation, using the reference GPS software 812 to derive an instantaneous error quantity or correction factor in known manner. This correction factor is broadcast from base station 802 to position station 804 on the mobile machine via radio link 816,822. Alternatively, raw position data can be transmitted from base station 802 to position station 804 via radio link 816,822, and processed by computer 818.

Machine-mounted receiver 202 receives position information from the satellite constellation, while the kinematic GPS software 820 combines the signal from receiver 202 and the correction factor from base reference 802 to determine the position of receiver 202 relative to base reference 802 and the work site within a few centimeters. This position information is three-dimensional (e.g., latitude, longitude and elevation) and is available on a point-by-point basis according to the sampling rate of the GPS system.

Referring to update/control module 806, once the digitized plans or models of the site have been loaded into computer 824, dynamic database 828 generates signals representative of the difference between actual and desired site geography to display this difference graphically on operator interface 830. For example, profile and/or plan views of the actual and desired site models are combined on screen 830 and the elevational difference between their surfaces and the relative ore content of material in different areas are indicated. Using the position information received from position module 804, the database 828 also generates a graphic icon of the machine superimposed on the actual site model on operator interface 830 corresponding to the actual position and direction of the machine on the site.

Because the sampling rate of the position module 804 results in a time/distance delay between position coordinate points as the machine operates, the dynamic database 828 of the present invention uses a differencing algorithm to determine and update in real-time the path of the receiver 202.

With the knowledge of the bucket's exact position relative to the site, a digitized view of the site, and the machine's progress relative thereto, the operator can maneuver the bucket to excavate material without having to rely on physical markers placed over the surface of the site. And, as the operator operates the machine within the work site the dynamic database 828 continues to read and manipulate incoming position information from module 804 to dynamically update both the machine's position relative to the site and the position and orientation of the bucket.

The mining shovel 102 is equipped with a positioning system capable of determining the position of the machine and/or its bucket 108 with a high degree of accuracy, in the preferred embodiment a phase differential GPS receiver 202 located on the machine at fixed, known coordinates relative to the stick 110. Machine-mounted receiver 202 receives position signals from a GPS constellation and an error/correction signal from base reference 808 via radio link 816,822 as described in FIG. 8. Machine-mounted receiver 202 uses both the satellite signals and the error/correction signal from base reference 808 to accurately determine its position in three-dimensional space. Alternatively, raw position data can be transmitted from base reference 808, and processed in known fashion by the machine-mounted receiver system to achieve the same result. Information on kinematic GPS and a system suitable for use with the present invention can be found, for example, in U.S. Pat. No. 4,812,991 dated Mar. 14, 1989 and U.S. Pat. No. 4,963,889 dated Oct. 16, 1990, both to Hatch. Using kinematic GPS or other suitable three-dimensional position signals from an external reference, the location of receiver 202 can be accurately determined on a point-by-point basis within a few centimeters as the mining shovel 102 operates within the work site. The present sampling rate for coordinate points using the illustrative positioning system is approximately one point per second.

The coordinates of base receiver 808 can be determined in any known fashion, such as GPS positioning or conventional surveying. Steps are also being taken in this and other countries to place GPS references at fixed, nationally surveyed sites such as airports. If the reference station is within range (currently approximately 20 miles) of such a nationally surveyed site and local GPS receiver, that local receiver can be used as a base reference. Optionally, a portable receiver such as 808, having a tripod-mounted GPS receiver, and a rebroadcast transmitter can be used. The portable receiver 808 is surveyed in place at or near the work site.

In the preferred embodiment, the work site has previously been surveyed to provide a detailed topographic design showing the mining engineer's finished site plan overlaid on the original site topography including ore location and overburden location in both plan and profile view. The creation of geographic or topographic designs of sites such as landfills, mines, and construction sites with optical surveying and other techniques is a well-known art; reference points are plotted on a grid over the site, and then connected or filled in to produce the site contours on the design. The greater the number of reference points taken, the greater the detail of the map.

Systems and software are currently available to produce digitized, three-dimensional maps of a geographic site. For example, the mining engineer's site plan can be converted into three-dimensional digitized models of the original site geography or topography. The site contours and ore locations can be overlaid with a reference grid of uniform grid elements in known fashion. The digitized site plans can be superimposed, viewed in two or three dimensions from various angles (e.g., profile and plan), and color coded to designate areas in which the site needs to be excavated, ore location of various quality, and overburden location. Available software can also make cost estimates and identify various site features and obstacles above or below ground.

However the work site is surveyed, and whether the machine operators and their supervisors are working from a paper design or a digitized site plan, the prior practice is to physically stake out the various contours or reference points of the site with marked instructions for the machine operators. Using the stakes and markings for reference, the operators must estimate by sight where and how much to excavate. Periodically during this process the operator's progress is manually checked to coordinate the contouring operations in static, step-by-step fashion until the final contour is achieved. This manual periodic updating and checking is labor-intensive, time consuming, and inherently provides less than ideal results.

Moreover, when it is desired to revise the design or digitized site model as an indicator of progress to date and work to go, the site must again be statically surveyed and the design or digitized site model manually corrected off-site in a non-real time manner.

To eliminate the drawbacks of prior art static surveying and updating methods, the present invention integrates accurate three-dimensional positioning and digitized site mapping with a dynamically updated database and operator display for real-time monitoring and control of the site 12 and machine 10.

Figure 9:
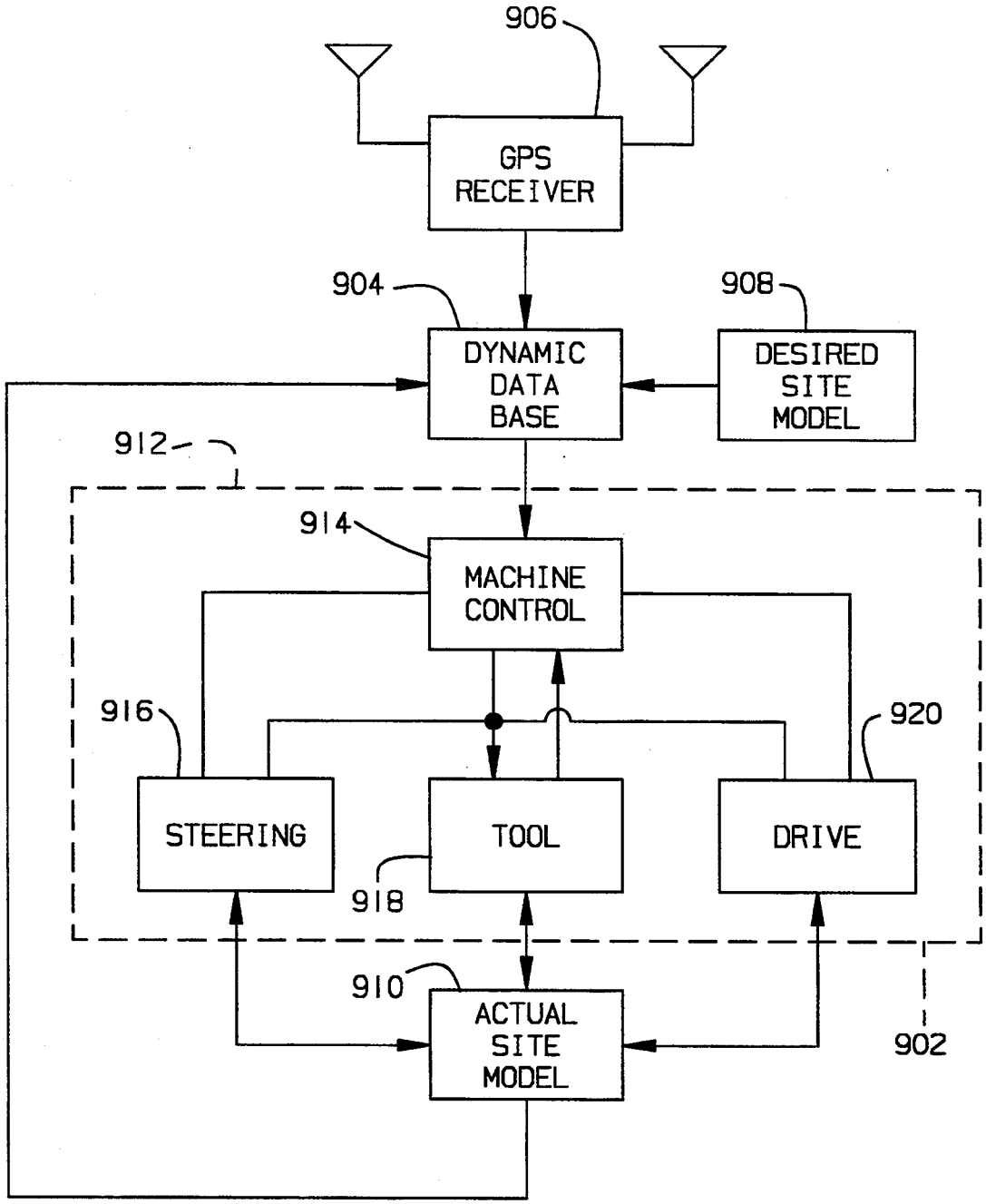
FIG. 9 is a block diagram of a machine control.

Referring now to FIG. 9, a system according to the present invention is schematically shown for closed-loop automatic control of one or more machine or tool operating systems. While the embodiment of FIG. 9 is capable of use with or without a supplemental operator display as described above, for purposes of this illustration only automatic machine controls are shown. A suitable digital processing facility, for example a computer as described in the foregoing embodiments, containing the algorithms of the dynamic database of the invention is shown at 904. The dynamic database 904 receives 3-D instantaneous position information from GPS receiver system 906. The desired digitized site model 908 is loaded or stored in the database of computer 904 in any suitable manner, for example on a suitable disk memory. Automatic machine control module 912 contains machine controls 914 connected to operate, for example, steering, tool and drive systems 916, 918, 920 on the mining shovel 102. Automatic machine controls 914 are capable of receiving signals from the dynamic database in computer 904 representing the difference between the actual site model 910 and the desired site model 908 to operate the steering, tool and drive systems of the machine to bring the actual site model into conformity with the desired site model. As the automatic machine controls 914 operate the various steering, tool and drive systems of the machine, the alterations made to the site and the current position and direction of the machine are received, read and manipulated by the dynamic database at 904 to update the actual site model. The actual site update information is received by database 904, which correspondingly updates the signals delivered to machine controls 914 for operation of the steering, tool and drive systems of the machine as it progresses over the site to bring the actual site model into conformity with the desired site model.

Figure 10:
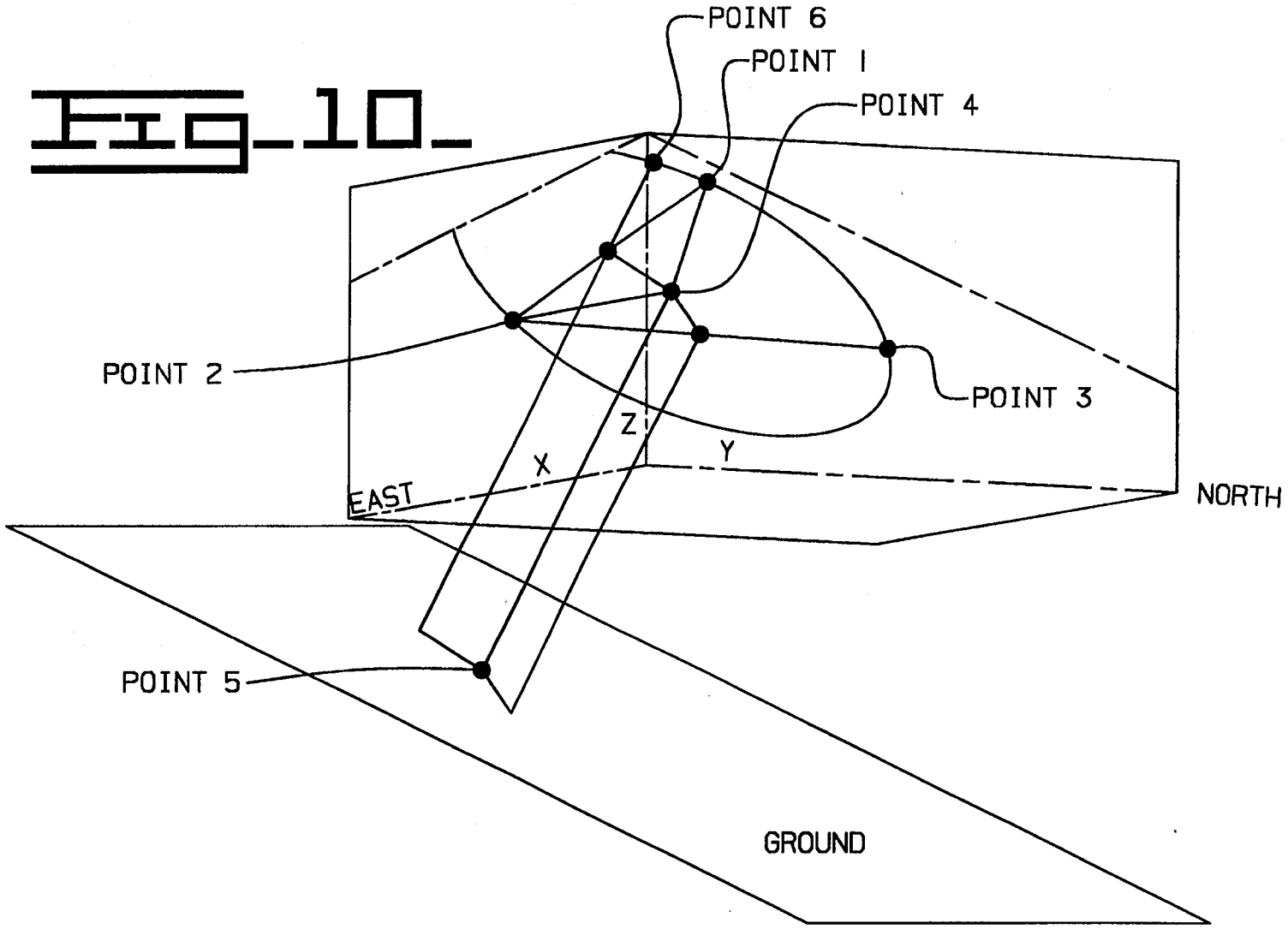
FIG. 10 illustrates the geometry on which portions of the system is based.

Turning now to the illustration of FIG. 10, the calculation of the location and orientation of the car body 106 and the location of the bucket 108 which is performed by the computer 824 is described. As described below, roll and pitch of an excavator refers to the side-side and fore-aft slope. Since a shovel rotates, roll and pitch continually varies from the operator's perspective in many operating environments. Therefore, the equation of the plane upon which the car body 106 rotates is calculated, and from this equation, the slope, or roll and pitch, can be displayed using whatever frame of reference is desired. The two most common frames of reference would be to display the surface using perpendicular axes determined by N–S and E–W, or along and transverse to the machines fore-aft axis.

The calculations listed below determine the equation of a plane from the x, y, and z coordinates of 3 points sampled by the receiver 202. For ease of understanding, arbitrary values were selected to provide sample calculations; however, none of the values used should in any way limit the generality of the invention and these formulae.

To calculate the Plane of Rotation Through 3 Sampled Points:

$$pt1 = (pt1x, pt1y, pt1z) \quad (1, 1, 3)\ PNT1$$
$$pt2 = (pt2x, pt2y, pt2z) \quad (7, 2, 2)\ PNT2$$
$$pt3 = (pt3x, pt3y, pt3z) \quad (2, 5, 1)\ PNT3$$
$$pt1x*A + pt1y*B + pt1z*C + D = 0$$
$$pt2x*A + pt2y*B + pt2z*c + D = 0$$
$$pt3x*A + pt3y*B + pt3z*c + D = 0$$

By solving the above formulae, the following solution is obtained:

$$-0.02439*pt_x-0.13414*pt_y-0.28049*pt_z+1=0$$

For a simple example, assume an operator is facing North (positive y direction in this example). The side-side roll is calculated by picking any two x values on a plane perpendicular to the direction and calculating the z values.

$$\text{For} \quad x = 0, y = 0, z = 3.56519$$
$$x = 7, y = 0, z = 2.9565$$

$$\text{Side-Side roll} = (2.9565 - 3.56519)/(7 - 0) = .08696$$
with West higher than East
$$= 4.96 \text{ degrees}$$

Similarly, the fore-aft pitch can be calculated;

$$\text{For} \quad x = 7, y = 0, z = 3.56519$$
$$x = 7, y = 5, z = 1.17402$$

$$\text{Fore-aft pitch} = ((1.17402 - 3.56519)/(5) = .47823$$
with South higher than North
$$= 25.56 \text{ degrees}$$

In the preferred embodiment, the center of rotation of the arc described by the rotation of the antenna and 3 sampled points is determined by locating the intersection of 3 planes. One plane is determined by the rotation of the antenna. A second plane is perpendicular to and extending through the midpoint of a line connecting pt 1 and pt 2. A third plane is perpendicular to and extending through the midpoint of a line connecting pt 2 to pt 3. Sample calculations to determine the center of rotation of the antenna rotation are listed below.

Calculate the Plane Perpendicular to Line From ptl and pt2 Through the Midpoint $$pt1 = (pt1x, pt1y, pt1z) \quad (1, 1, 3)$$
$$pt2 = (pt2x, pt2y, pt2z) \quad (7, 2, 2)$$

midpt_1_2=((pt1x+pt2x)/2, (pt1y+pt2y)/2, (pt1z+pt2z)/2)
midpt_1_2=(4,1.5,2.5)
dir_num_x=pt2x−pt1x=6
dir_num_y=pt2y−pt1y=1
dir_num—z=pt2z−pt1z=−1 where dir_num_x, dir_num_y, and dir_num_z refer to the direction number of x, y, and z, respectively.

0=dir_num_x* (X-midpt_1_2x)+dir_num_y* (Y-midpt_1_2_y)+dir_num_z* (Z-midpt_1_2z)

where midpt_1_2x, midpt_1_2y, and midpt_1_2_z refer to the x, y, and z coordinates, respectively, of the midpoint of the line connecting pt1 and pt 2.

Solving for the equation of the plane provides:

$$0=6pt_x+pt_y-pt_z-23$$

Similarly, calculate the Plane Perpendicular to Line From pt2 and pt3 Through the Midpoint.

$$pt2 = (pt2x, pt2y, pt2z) \quad (7, 2, 2)$$
$$pt3 = (pt3x, pt3y, pt3z) \quad (2, 5, 1)$$

midpt_2_3=((pt2x+pt3x)/2, (pt2y+pt3y)/2, (pt2z+pt3z)/2)
midpt_2_3=(4.5,3.5,1.5)
dir_num_x=pt3x−pt2x=−5
dir_num_y=pt3y−pt2y=3
dir_num—z=pt3z−pt2z=−1

0=dir_num_x* (X-midpt_2_3_x)+dir_num_y* (Y-midpt_2_3_y)+dir_num_z*(Z-midpt_2_3_z)

0=−5pt_x+3pt_y−pt_z+13.5

Calculate Point of Intersection Between Plane of Rotation, Plane Perpendicular to Midpoint Pt1_2, and Plane Perpendicular to Midpoint Pt2_3

$$-.02439*pt_x - .13414*pt_y - .28049*pt_z + 1 = 0$$
= Plane of Rotation $$6pt_x + pt_y - pt_z - 23 = 0$$
= Plane Perp to Midpt $Pt1_2$ $$-5pt_x + 3pt_y - pt_z + 13.5 = 0$$
= Plane Perp to Midpt $Pt2_3$ $$23pt_y - 11pt_z - 34 = 0$$
= Intersection of the 2 Planes through Midpoints To calculate the point of the center of rotation of the receiver:

$$-.02439*pt_x - .13414*pt_y - .28049*pt_z + 1 = 0$$
$$6pt_x + pt_y - pt_z - 23 = 0$$

$$pt_y = -2.1876pt_z + 6.96909$$

$$pt_z_ant_rot_center = 2.05968$$

$$pt_y_ant_rot_center = (11pt_z + 34)/23 = 2.46333$$

$$pt_x_ant_rot_center = (-pt_y + pt_z + 23)/6 = 3.76606$$

Once the center of rotation is known, the distance to any of the previously sampled 3 points is the radius of the antenna rotation. For the shovel system in which the antenna is mounted to the linkage, this radius will be a function of the height of antenna rotation above the ground.

Calculate The Radius of the Arc of the antenna rotation.

$$\text{radius} = ((pt_x_ant_rot_center - pt1x)\ 2 + (pt_y_ant_rot_center - pt1y)\ 2 + (pt_z_ant_rot_center - pt1z)\ 2)\ .5$$

According to the above sample calculations, radius=3.26751

Once the height of antenna rotation above the ground is determined from a look up table or equation which contains basic linkage data (or a fixed distance if the antenna is mounted on the carbody), the intersection of the line of carbody rotation and the ground can be calculated. This point is important because the z coordinate indicates the elevation of the ground directly beneath the machine which can be compared to the desired bench height.

Calculate the Point of Intersection with the Ground.

From the machine geometry, a table or equation is provided in the memory associated with the computer 824 for correlating the radius of antenna rotation to the distance from the plane of antenna rotation to the ground. Note by reference to FIG. 3 that when the stick 110 is at a known point of extension or retraction, the radius of antenna rotation corresponds to a unique height of the plane of rotation above the ground, provided the bucket is not hoisted above a point at which the stick is substantially horizontal with respect to the plane of rotation. In the preferred embodiment, the known point of extension or retraction is the fully extended or fully retracted position.

Assume now that the following values were included in the radius versus height look-up table:

height=5 for radius=3.26751

The equation of a line perpendicular to the plane through the center of antenna rotation as derived above is:

−0.02439*pt_x−0.13414*pt_y−0.28049*pt_z+1=0 pt_x_ant_rot_center=3.76606 pt_y_ant_rot_center=2.46333 pt_z_ant_rot_center=2.05968 pt_x_gnd_rot_center=3.76606−0.02439t pt_y_gnd_rot_center=2.46333−0.13414t pt_z_gnd_rot_center=2.05968−0.28049t $$\text{height} = 5 = ((-.02439t)\ 2 + (.13414t)\ 2 + (.28049t)\ 2)\ .5$$
$$5 = .31187t;\ t = 16.03231$$

pt_x_gnd_rot_center=3.76606−0.02439t=3.37503 pt_y_gnd_rot_center=2.46333−0.13414t=0.31276 pt_z_gnd_rot_center=2.05968−0.28049t=2.43722

Where pt_x_gnd_rot_center, pt_y_gnd_rot_center, and pt_z_gnd_rot_center are the coordinates in x, y, and z, respectively, of the intersection of the axis of rotation with the ground.

Now, enough information is known to display the shovel location and linkage position relative to the surroundings. With a known location and orientation of the shovel, each point of the receiver 202 defines a unique location of the bucket 108. As the shovel works and rotates, the angular rotation can also be calculated and displayed.

At first, it would seem that since the line of rotation is known and the coordinates of the GPS antenna are continually being sampled, that the plan view could be displayed simply by monitoring the X, y coordinates of the antenna relative to the center of rotation. However, since the present invention is a general system in which the antenna does not have to be mounted along the linkage axis, it is possible to have identical x,y antenna coordinates for different carbody rotations. This possible outcome is illustrated in FIGS. 11*a* and 11*b*.

Figure 11A:
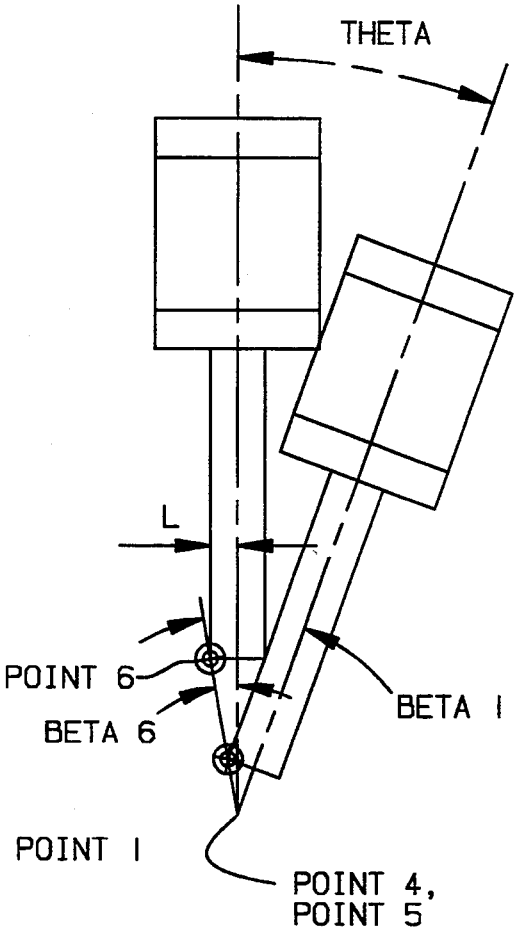
FIGS. 11*a* and 11*b* illustrates the stick and bucket in various positions with the receiver at different locations on the stick.
Figure 11B:
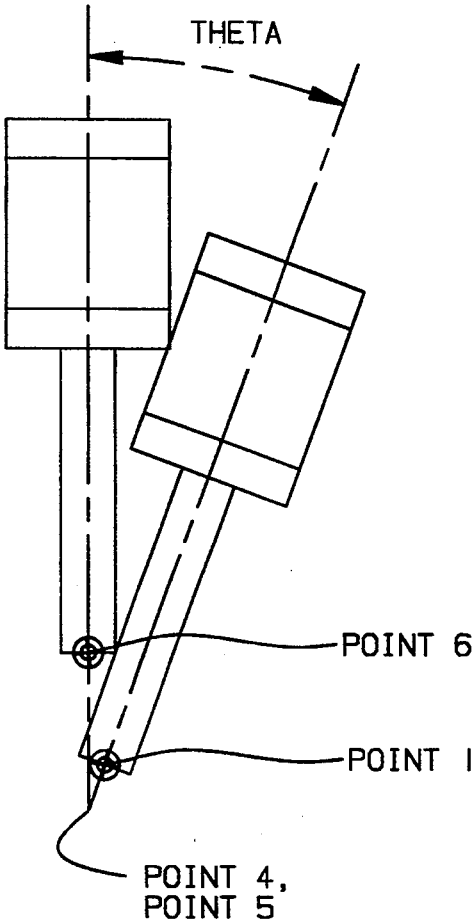
Figure 12A:
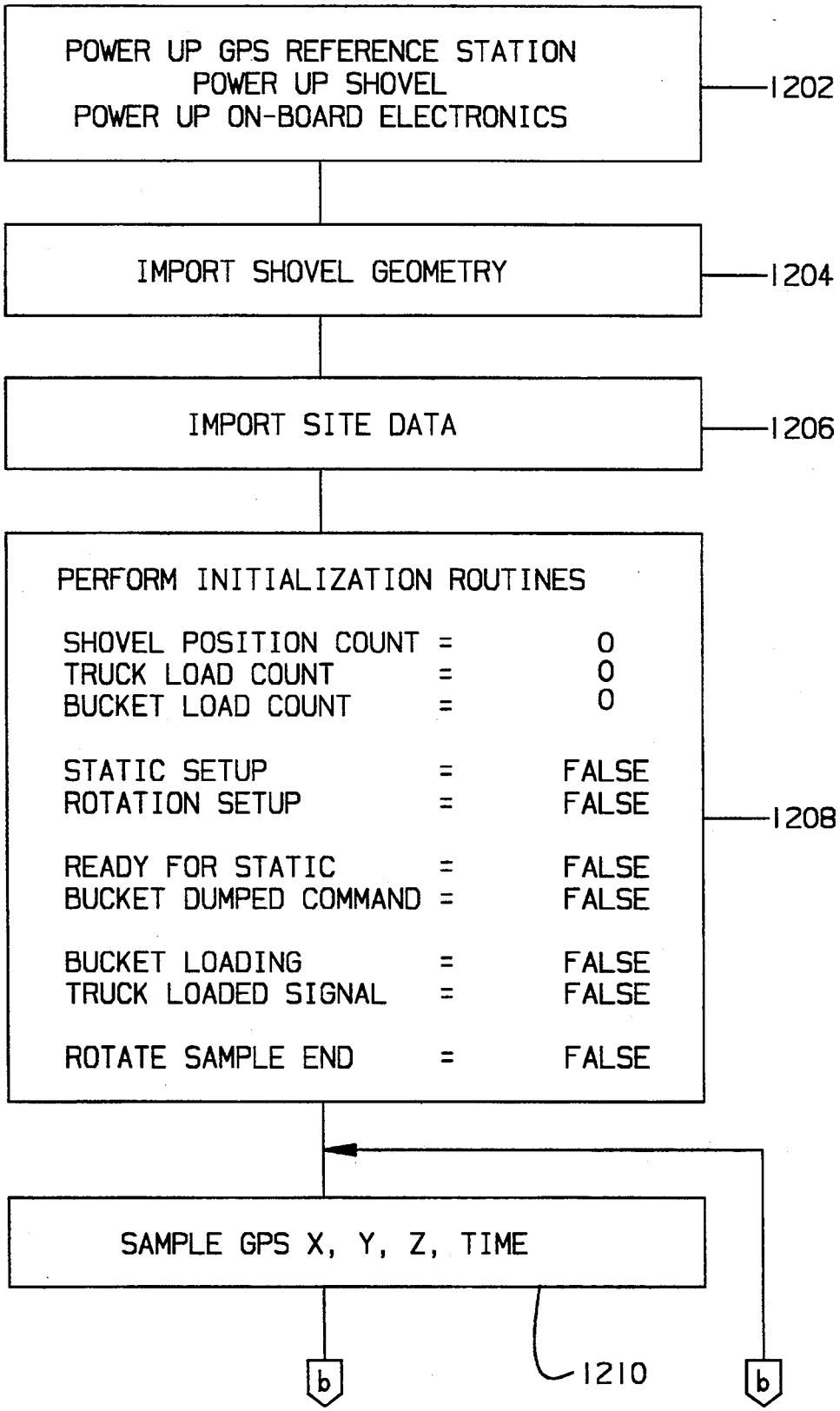
FIGS. 12*a* through 12*i* illustrate a flow chart of an algorithm used in an embodiment of the invention.
Figure 12B:
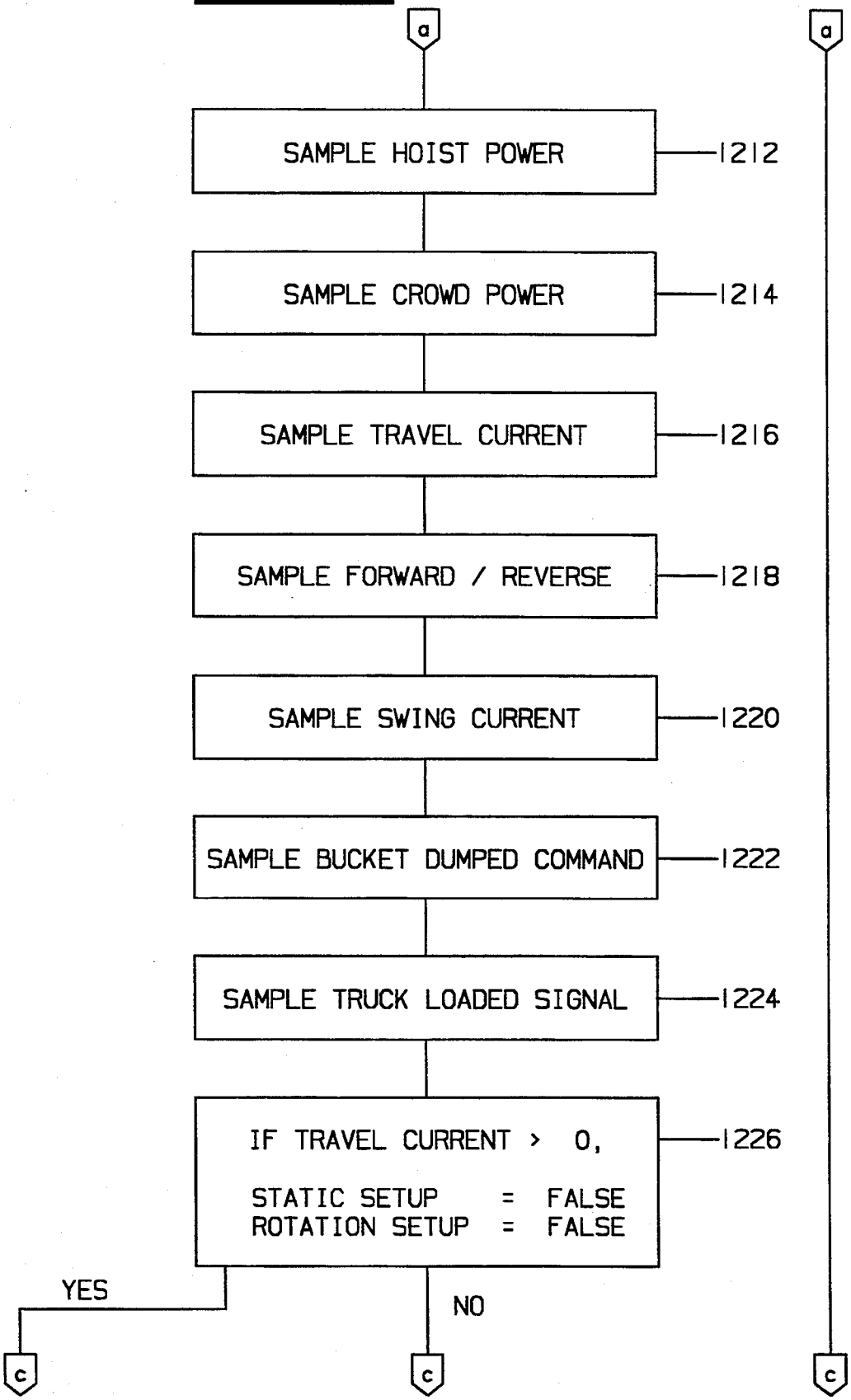
Figure 12C:
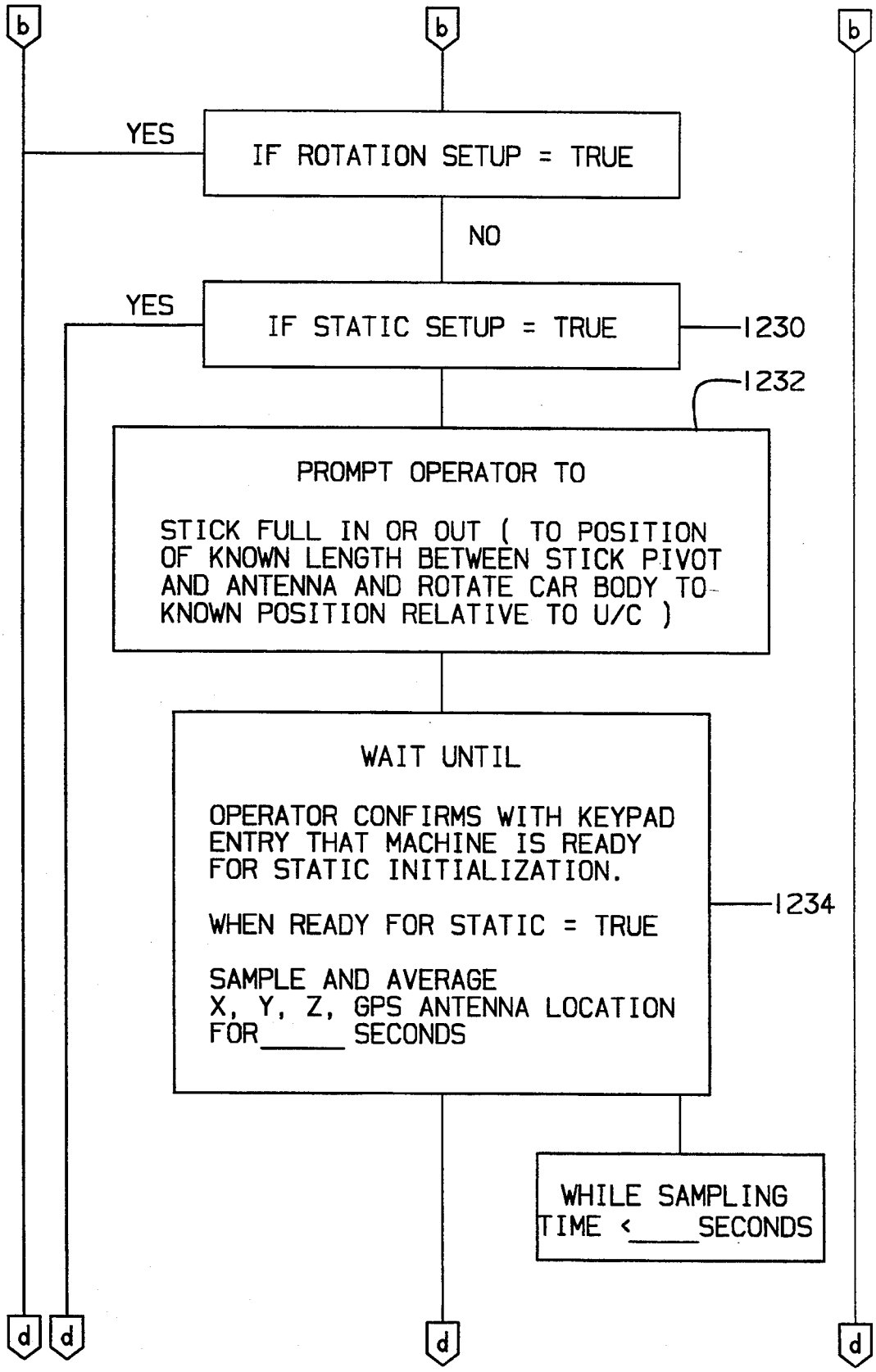
Figure 12D:
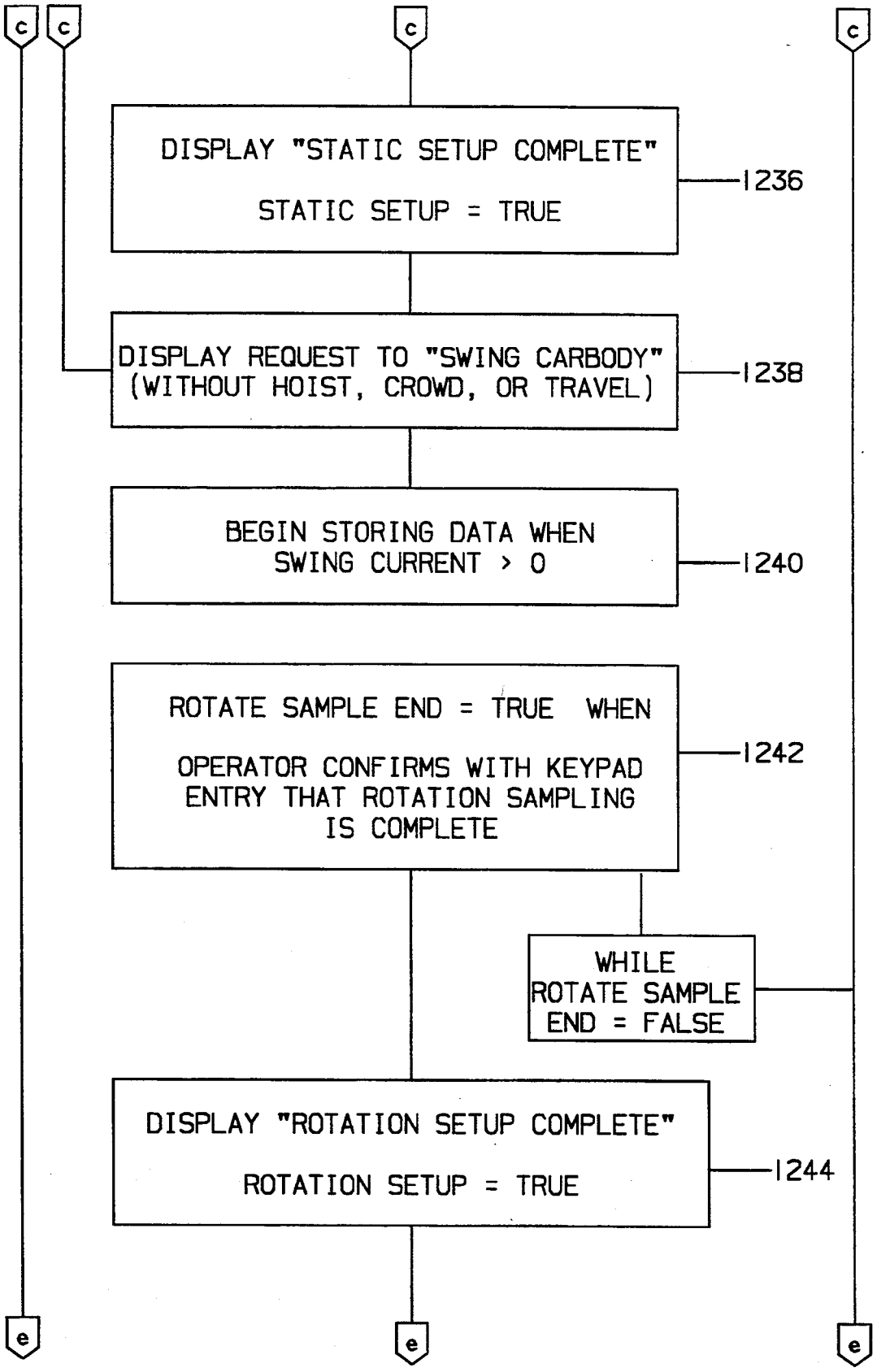
Figure 12E:
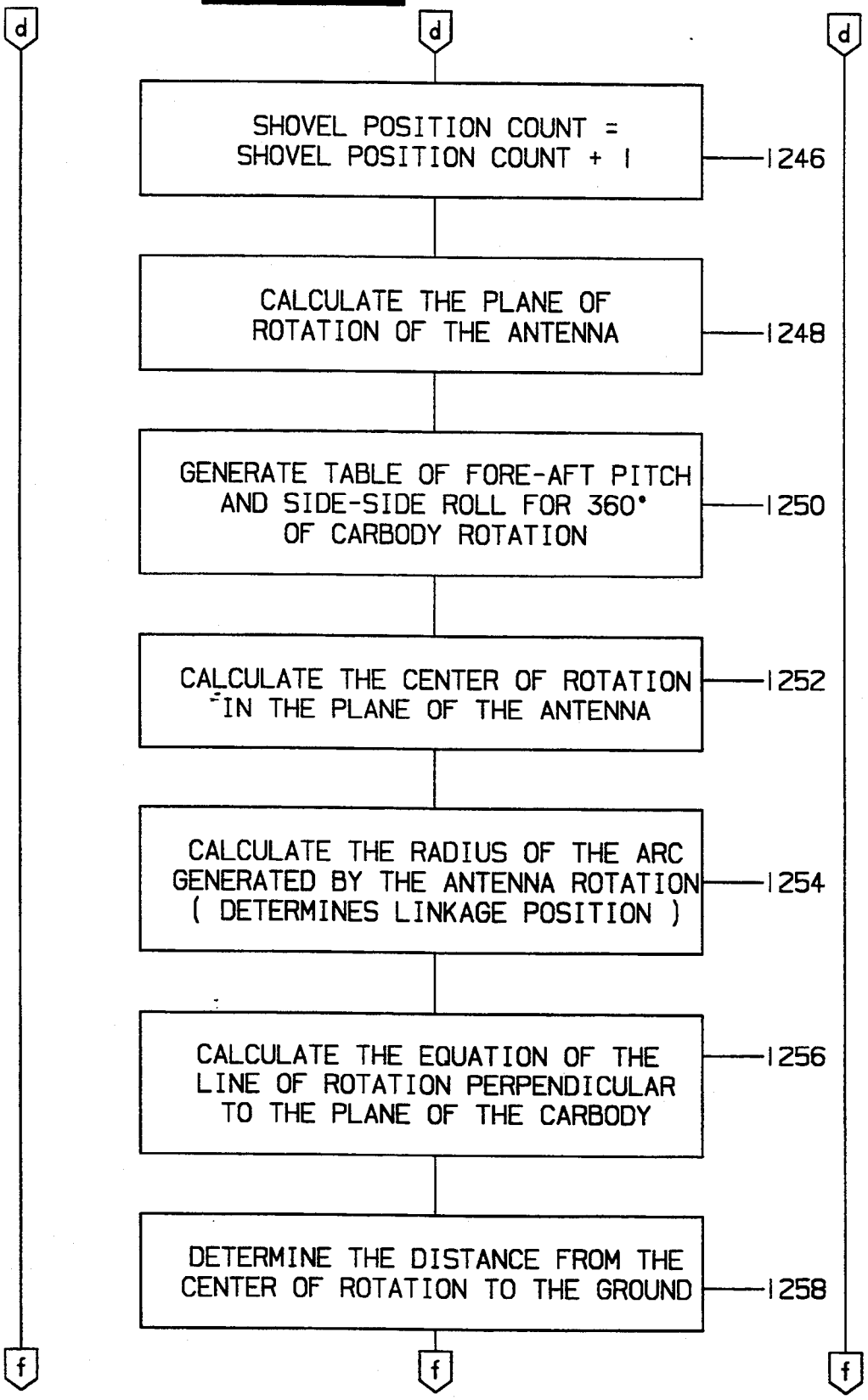
Figure 12F:
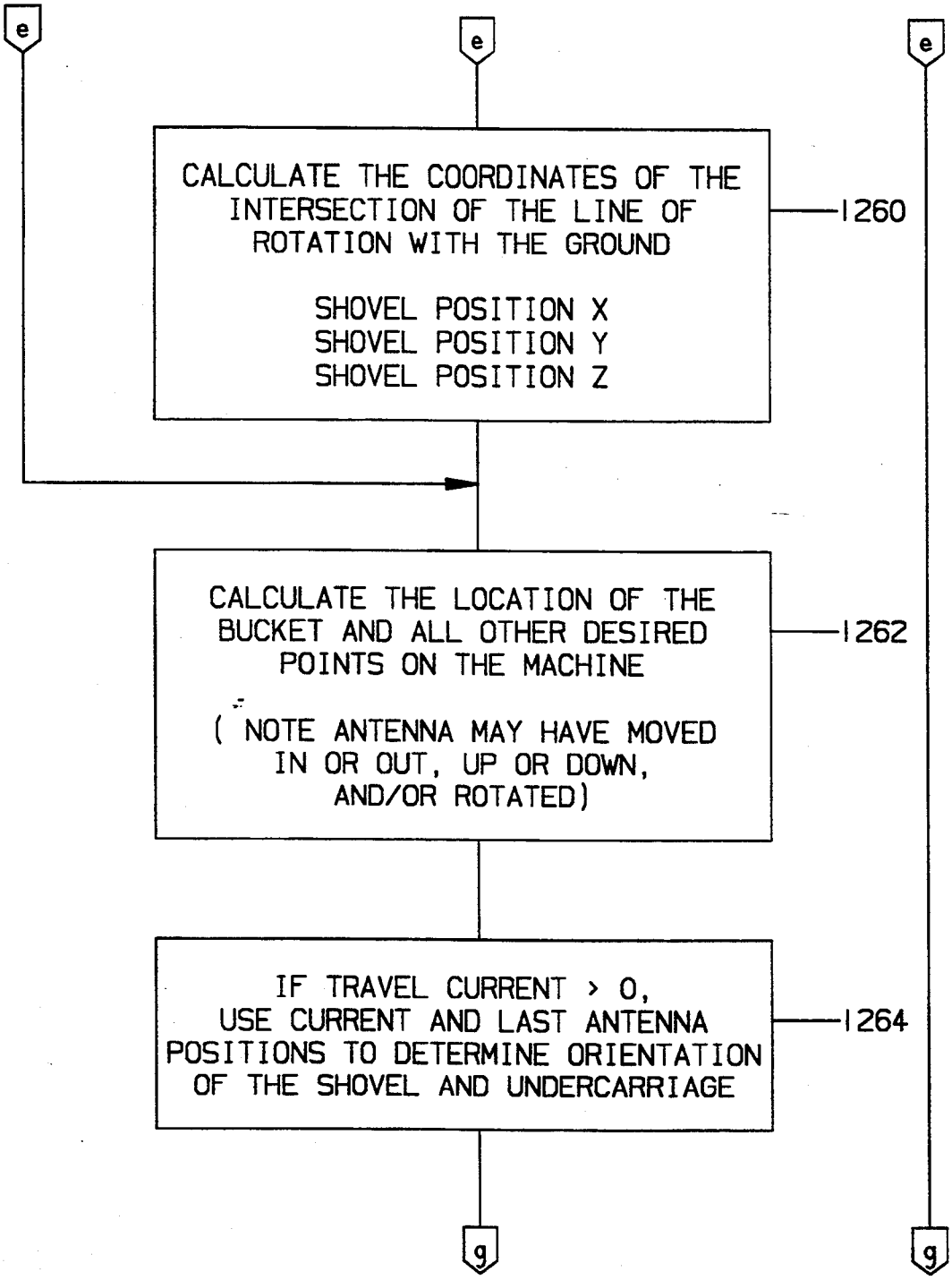
Figure 12G:
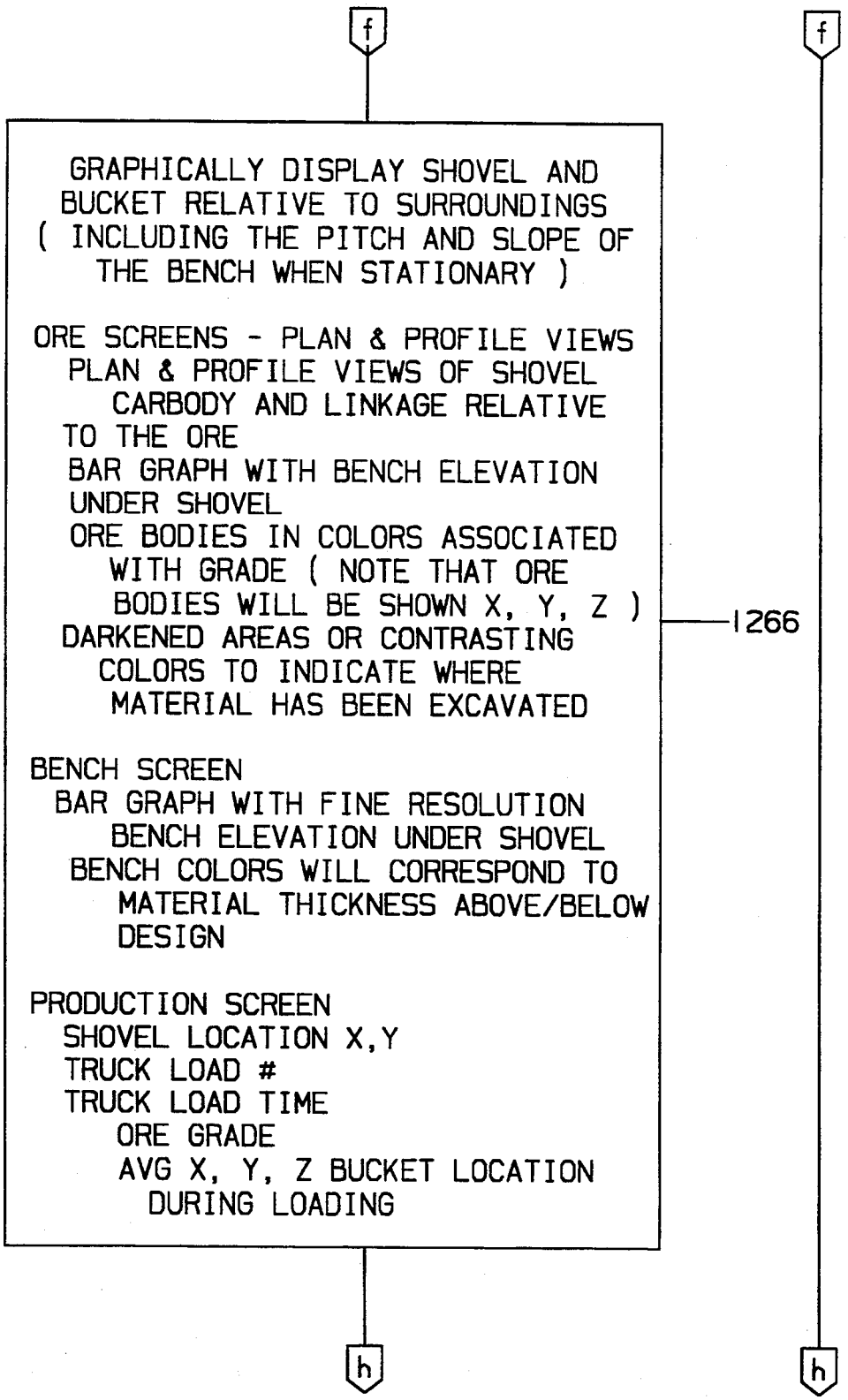
Figure 12H:
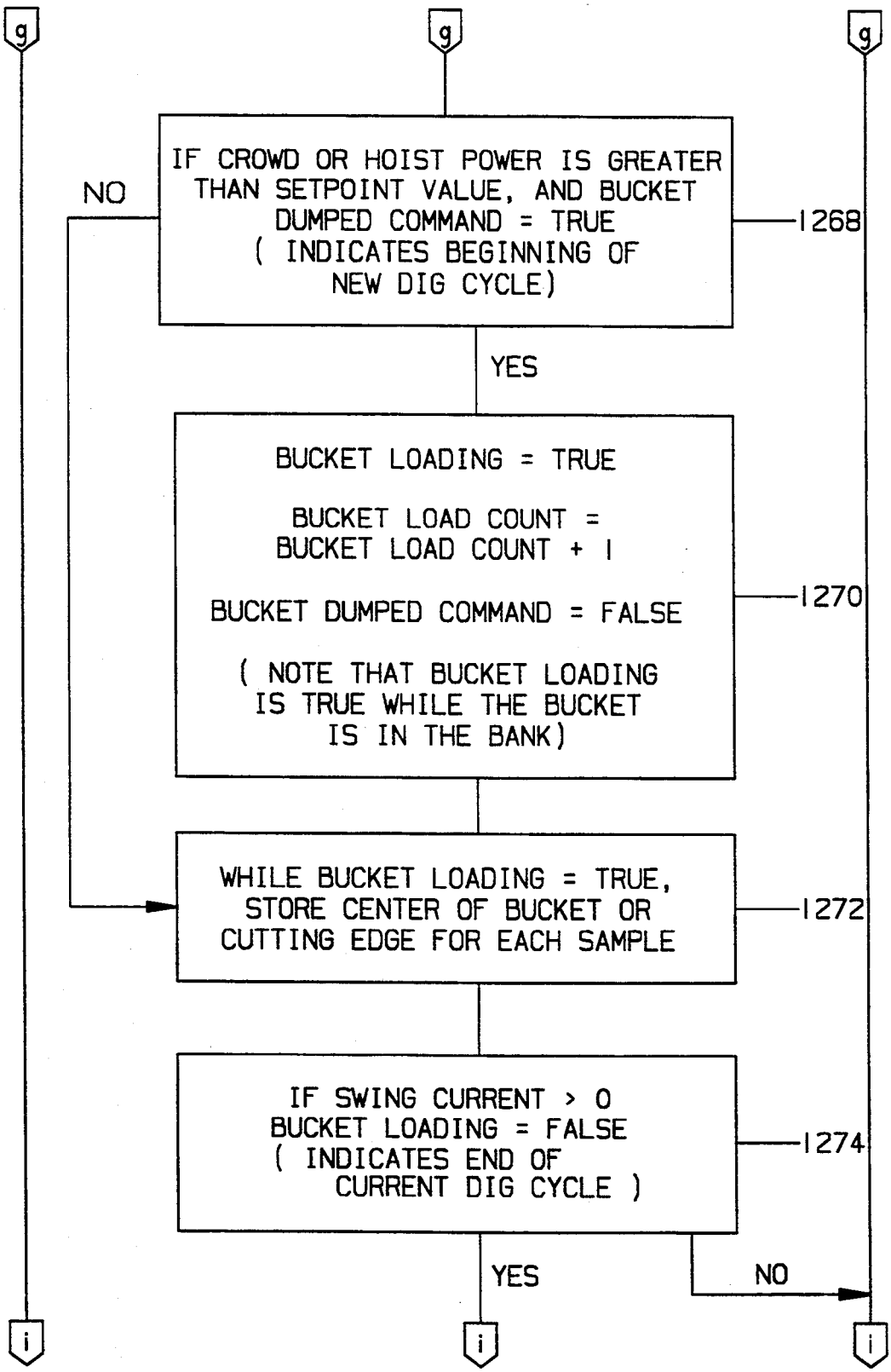
Figure 12I:
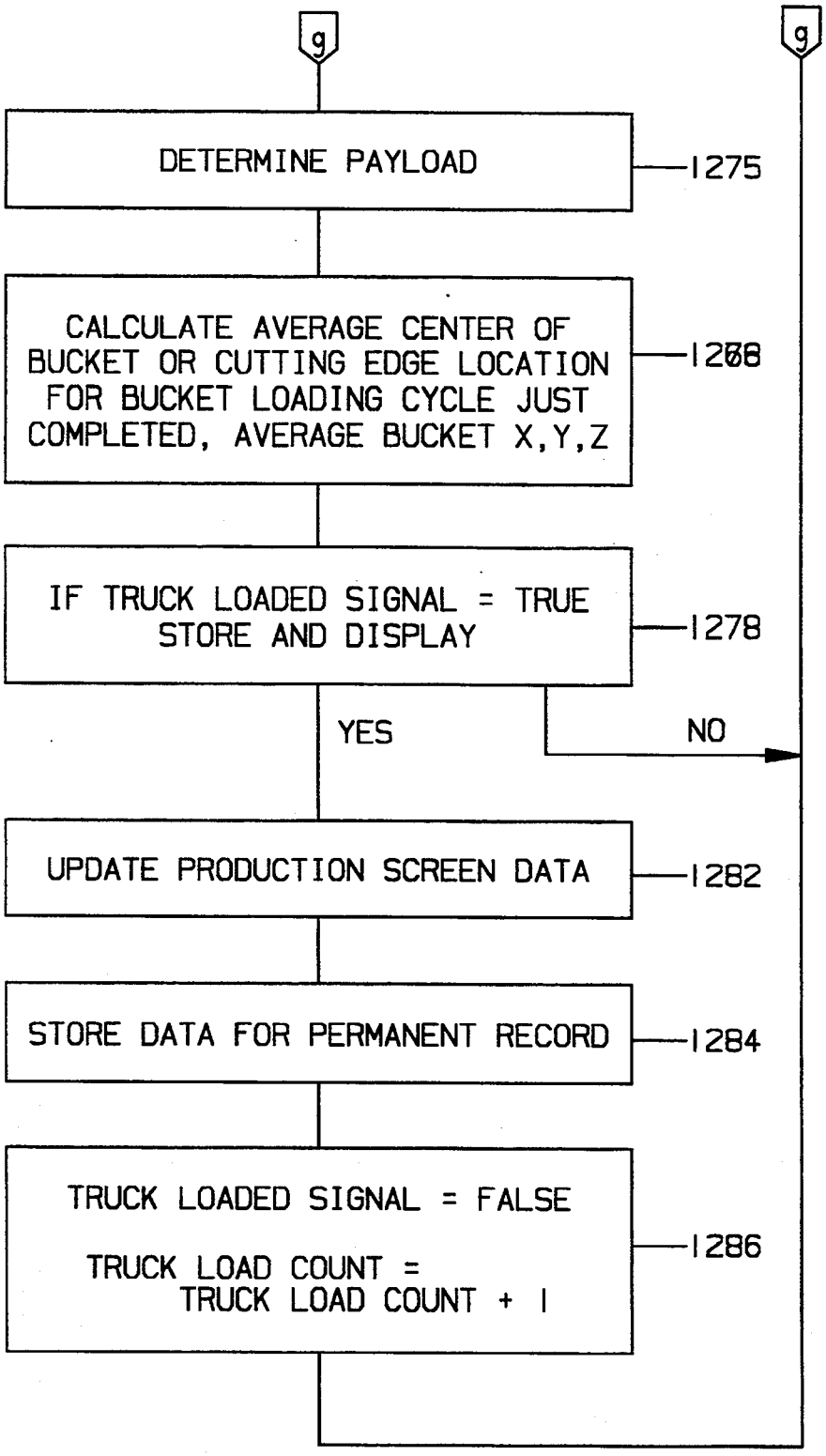

FIG. 11*a* illustrates the receiver 202 located off the centerline of the stick. In this embodiment, it can be seen that if the car body rotates at the same time the stick is retracted, the angular offset of the receiver from its original location is substantially different from the angular movement of the stick itself, represented by the angle theta. FIG. 11*b*, on the other hand, illustrates an embodiment in which the receiver 202 is connected to the stick along its centerline. In this case, the angular offset of the receiver 202 from its original location is also equal to theta.

To compensate for the case illustrated in FIG. 11*a*, a plane is calculated through each sampled point and 2 fixed points along the axis of rotation, the center of rotation of the initial antenna arc and the intersection of the line of rotation with the ground. Sample angle calculations are shown below.

To calculate the rotation angle of the carbody from pt1 to pt2:

$$\left.\begin{array}{l} pt_x_ant_rot_center = 3.76606\ PNT4 \\ pt_y_ant_rot_center = 2.46333\ PNT4 \\ pt_z_ant_rot_center = 2.05968\ PNT4 \\ pt_x_gnd_rot_center = 3.37503\ PNT5 \\ pt_y_gnd_rot_center = .31276\ PNT5 \\ pt_z_gnd_rot_center = 2.43722\ PNT5 \end{array}\right| \text{—These points are fixed for a given loading location.}$$

$$\begin{array}{l} pt1x = 1.0\ PNT1 \\ pt1y = 1.0\ PNT1 \\ pt1z = 3.0\ PNT1 \end{array}$$

$$\begin{array}{l} 3.76606A + 2.46333B + 2.05968C + D = 0 \\ 3.37503A + .31276B - 2.43722C + D = 0 \\ A + B + 3C + D = 0 \end{array}$$

Solving provides:

$$\underset{A1}{-.72136x} + \underset{B1}{1.07387y} - \underset{C1}{.45083z} + \underset{D1}{1} = 0$$

$$\left.\begin{array}{l} pt_x_ant_rot_center = 3.76606\ PNT4 \\ pt_y_ant_rot_center = 2.46333\ PNT4 \\ pt_z_ant_rot_center = 2.05968\ PNT4 \\ pt_x_gnd_rot_center = 3.37503\ PNT5 \\ pt_y_gnd_rot_center = .31276\ PNT5 \\ pt_z_gnd_rot_center = 2.43722\ PNT5 \end{array}\right| \text{—These points are fixed for a given loading location.}$$

$$\begin{array}{l} pt6x = 1.16048\ PNT6 \\ pt6y = .78234\ PNT6 \\ pt6z = 3.09014\ PNT6 \end{array}$$

$$\begin{array}{l} 3.76606A + 2.46333B + 2.05968C + D = 0 \\ 3.37503A + .31276B - 2.43722C + D = 0 \\ 1.16048A + .78234B + 3.09014C + D = 0 \end{array}$$

$$\underset{A2}{-.5708x} + \underset{B2}{.70838y} - \underset{C2}{.28848z} + \underset{D2}{1} = 0$$

cos (theta) =

$$\frac{(A1A2 + B1B2 + C1C2)\ \ 2)\ \ .5}{((A1\ \ 2 + B1\ \ 2 + C1\ \ 2))\ \ .5 * ((A2\ \ 2 + C2\ \ 2))\ \ .5}$$

cos (theta) =

$$\frac{((-.72136* - .5708 + 1.07387*.70838 - .45083* - .28848)\ \ 2)\ \ .5}{((-.72136)\ \ 2 + 1.07387\ \ 2 + (-.45083)\ \ 2)\ \ .5* ((-.5708)\ \ 2 + .70838\ \ 2 + (-.28848\ \ 2))\ \ .5}$$

cos(theta) = .99622 theta = 4.9862 degrees

Where theta=the angle between planes defined by points 4, 5, 6 and points 1, 4, 5 plus Beta 1 minus Beta 6.

A flow chart of an algorithm to be executed by the computer 824 in one embodiment of the invention is illustrated in FIGS. 12*a*–12*i*. The GPS reference station 802, the mining shovel 102, and the on-board electronics are powered up at block 1202. The shovel geometry and site data are uploaded to the computer 824 form the data base 828 in blocks 1204 and 1206, respectively. The variables and flags listed in block 1208 are initialized. The GPS position of the receiver 202 is sampled and time stamped at block 1210. The signals from the hoist power sensor 832, crowd power sensor 834, travel current sensor 836, forward/reverse indicator 838, swing current sensor 840, bucket dumped sensor 842, and truck loaded indicator 844 are sampled at blocks 1212–1224, respectively.

If travel current is greater than zero at block 1226 thus indicating that the undercarriage is moving, then the static_setup and rotation_setup flags are set equal to "false" and control passes to block 1262. Similarly if rotation_setup is true at block 1228 thus indicating that the rotation setup at that location has been completed, control passes to block 1262. If static_setup is true at block 1230 thus indicating that the static_setup has been completed, then control passes to block 1238.

At block 1232, the operator is prompted via the operator interface 830 to use the crowd control to move the stick to either the full in or full out position. Whether full in or full out is selected is a simple matter of design choice for the system designer. The operator then uses a keypad included in the operator interface to indicate that the stick has been moved to the requested position. When the ready_for_static flag is therefore set equal to "true", the receiver 202 location is sampled and averaged for a predetermined length of time. The phrase "static setup complete" is then displayed on the operator interface 830 and the static_setup flag is set equal to "true" at block 1236.

At block 1238, the operator interface 830 displays the message "swing car body". The operator is instructed that the hoist, crowd, and travel controls are not to be manipulated during swing. When swing_current is sensed to exceed zero, receiver 202 locations derived by the kinematic GPS system are stored at regular intervals until the operator indicates via the keypad that rotation sampling is complete at block 1242. The operator interface 830 then indicates the "rotation setup is complete" and the rotation_setup flag is set equal to "true". The shovel_position_count is incremented at block 1246.

The plane of rotation of the receiver 202 is calculated in block 1248 as described above in connection with FIG. 10. The computer 824 then calculates at block 1250 a look-up table of the fore-aft pitch and side-side roll of the car body for the 360 degrees of rotation. Alternatively, the North-South inclination and East-West inclination of the car body is displayed on the operator interface 830.

At blocks 1252 and 1254, the center of rotation of the plane of receiver rotation and the radius of the arc described by the receiver 202 movement are calculated as described above in connection with FIG. 10. The equation of the line of rotation perpendicular to the plane of the car body 106 is calculated at block 1256 and the distance from the center of rotation of the receiver 202 from the ground is calculated at block 1258. The coordinates of the intersection of the line of rotation with the ground is determined at block 1260. At block 1262, the location of the bucket 108 is determined in response to the location of the receiver 202 and the above calculated values.

If travel current is greater than zero at block 1264, then the current and last receiver positions are used to calculate the location of the mining shovel 102. In the preferred embodiment, it is assumed that travel occurs only when front of the car body 106 is facing in the direction of undercarriage travel. This assumption allows ease of tracking of the shovel during travel.

Alternatively, the position of the work machine is only calculated, and the machine displayed at the work site, in response to the sampled points fitting the definition of a circle. This generally will occur only when the carbody rotates and the undercarriage is stationary.

Figure 13:
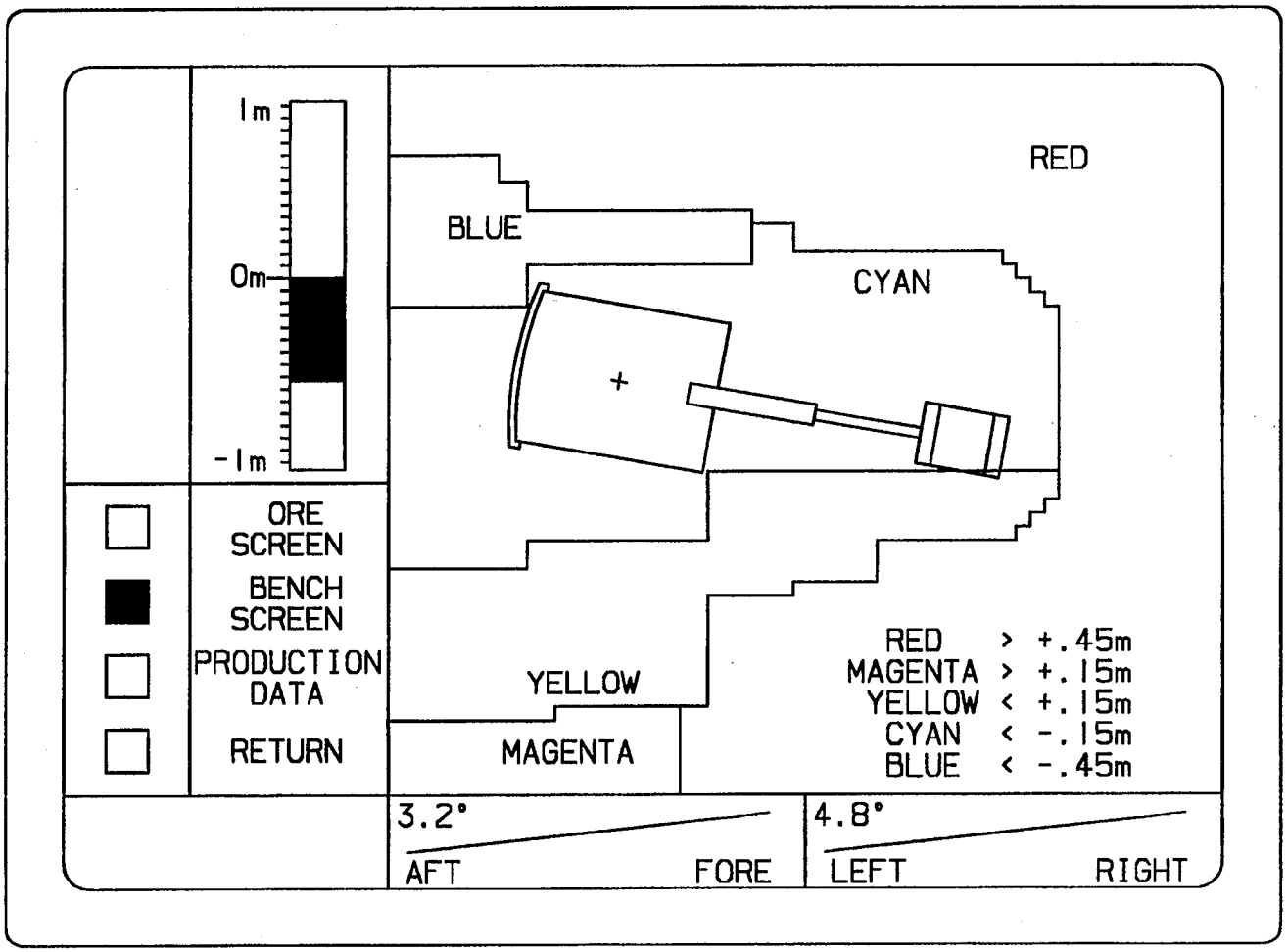
FIG. 13 illustrates the bench screen.
Figure 14:
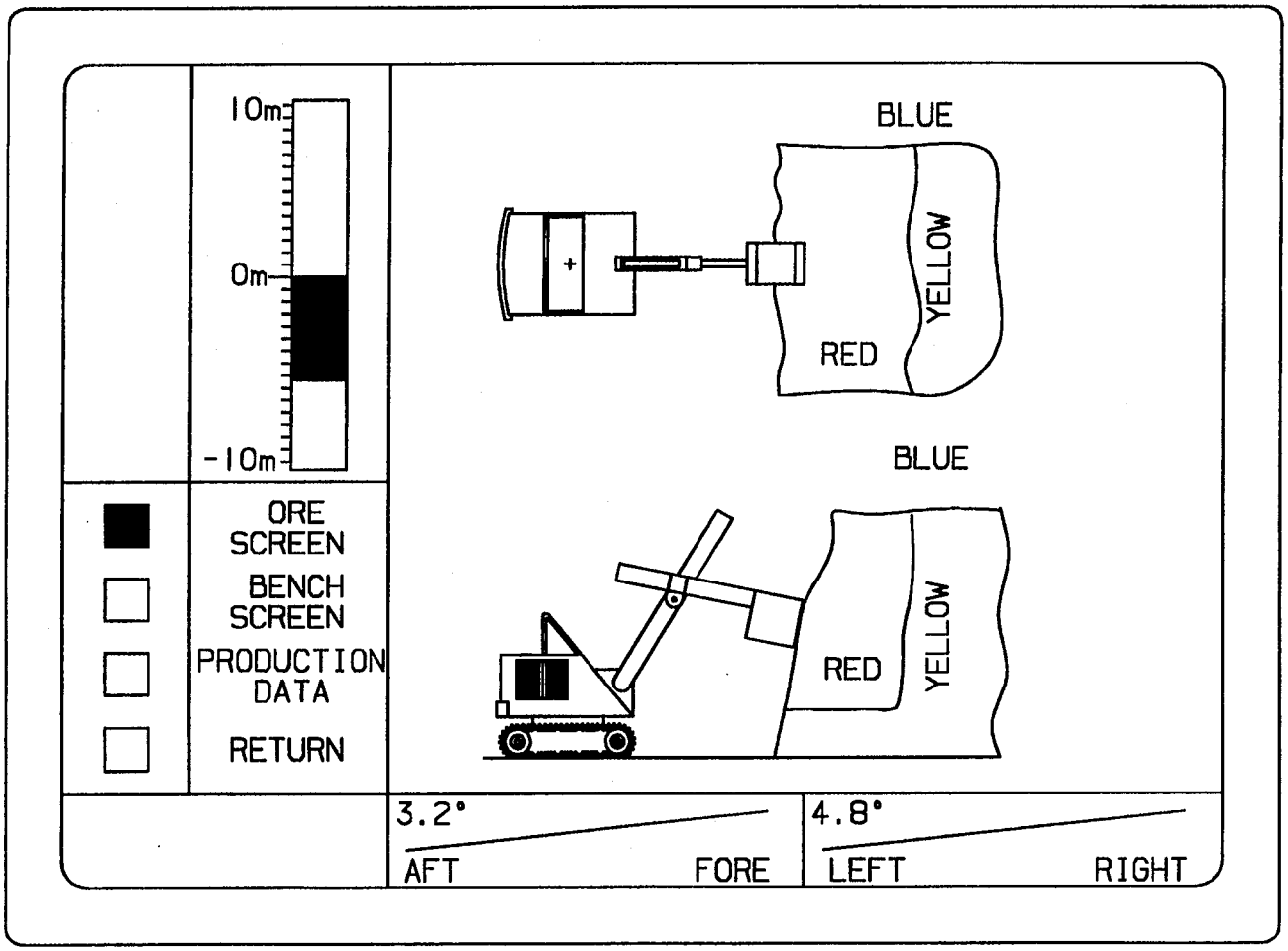
FIG. 14 illustrates the ore screen.

At block 1266, the shovel and bucket relative to the work site are displayed. As shown in FIGS. 13 and 14, a bench screen and an ore screen are displayed on the operator interface 830. A production screen is also available for display in text form including the number of trucks loaded, the number of bucket loads, the average time required to load a truck, average bucket location during loading of a truck, the grade of ore being excavated, payload excavated and the like.

The bench screen shown in FIG. 13 illustrates a plan view of the mining shovel 102 in the work site with various ranges of elevation with respect to the plan bench elevation being designated by a plurality of colors. A bar graph is also illustrated in the upper left hand area of the operator interface indicating the elevation with respect to desired bench elevation of the point of intersection of the axis of rotation with the ground. The lower portion of the operator interface 830 also indicates the fore-aft pitch and the side-side roll of the car body. The left hand portion of the illustration may be designed as either a touch screen or a separate key pad for selecting the available display screens.

The ore screen shown in FIG. 14 illustrates both a plan and profile view of the mining shovel 102 in the work site with overburden and ore indicated by various colors. Different grades of ore may also be designated by different colors on the display. Areas that have already been excavated are indicated by still a different color. A bar graph is also illustrated in the upper left hand area of the operator interface indicating the elevation with respect to desired bench elevation of the point of intersection of the axis of rotation with the ground. The lower portion of the operator interface 830 also indicates the fore-aft pitch and the side-side roll of the car body. The left hand portion of the illustration may be designed as either a touch screen or a separate key pad for selecting the available display screens.

Returning now to the flow chart of FIG. 12, block 1268 determines whether the sensed crowd or hoist power is greater than respective setpoint values to indicate that the bucket 108 has entered the material and is excavating. If the shovel is not digging, control passes to block 1272. If the shovel is excavating material, the bucket_loading flag is set to "true", the bucket_load_count is incremented, and the bucket_dumped_command flag is set to "false". At block 1272, the center of the bucket or cutting edge is calculated and stored for each sample of receiver location as long as the bucket_loading flag is "true".

If swing_current is greater than zero, then the bucket_loading flag is set to "false" at block 1274 and the payload is determined at block 1275. As is understood by those skilled in the art, payload is determined at block 1275 in response to the hoist power signal, shovel geometry, and stick/bucket position obtained from the present invention. The average center of bucket or cutting edge location for the bucket loading cycle just completed is calculated at block 1276. Using the shovel geometry imported in block 1204, the area that has been excavated is determined in response to the average center of bucket or cutting edge location and the dimensions of the bucket. If the swing_current is substantially zero, control passes back to block 1210.

If truck_loaded_signal flag is "true", then the average center of bucket or cutting edge location for the just completed loading cycle is stored and the display is updated at blocks 1278 and 1282. Otherwise, control passes to block 1210. The data is stored for a permanent record at block 1284. The truck loaded signal flag is set to "false" and the truck_load_count is incremented at block 1286. Control then returns to block 1210.

Turning now to FIGS. 15*a–c* and 16*a–b*, an alternative method of indicating the location of material having been excavated by the shovel is illustrated in flow chart form and is advantageously included in the calculations of block 1276. As described above, the work site is displayed in grid form. An accurate determination of the grid squares through which the bucket 108 passes is necessary to provide real time updates of the operator's work on the dynamic site plan. The size of the grid elements on the digitized site plan is fixed, and although the width of several grid elements can be matched evenly to the width of the bucket, the blade will not always completely cover a particular grid element. Even if the bucket width is an exact multiple of grid element width, it is rare that the machine would travel in a direction aligned with the grid elements so as to completely cover every element in its path.

Figure 15A:
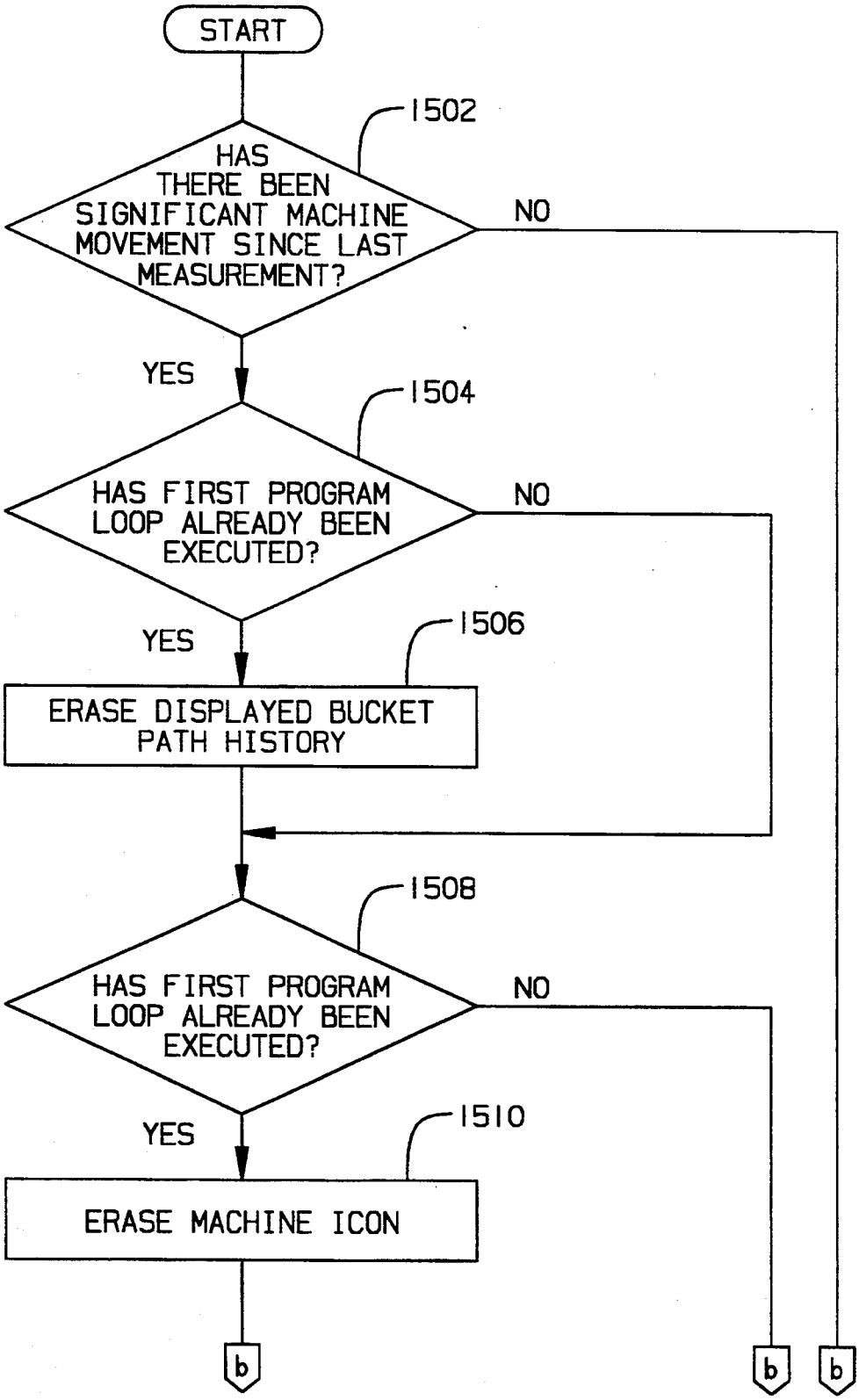
FIGS. 15*a–c* illustrate a flow chart of an algorithm used in an embodiment of the invention.
Figure 15B:
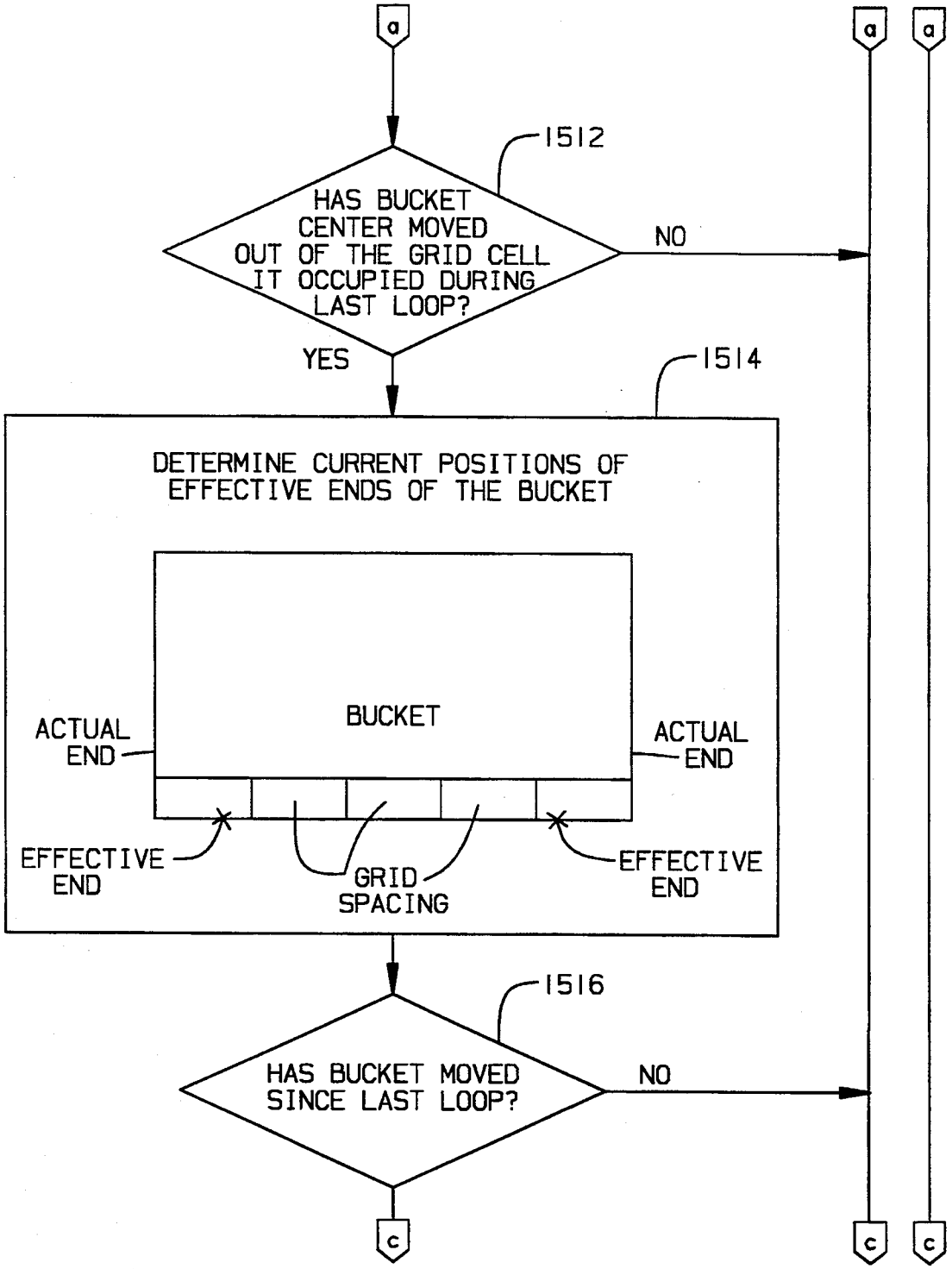
Figure 15C:
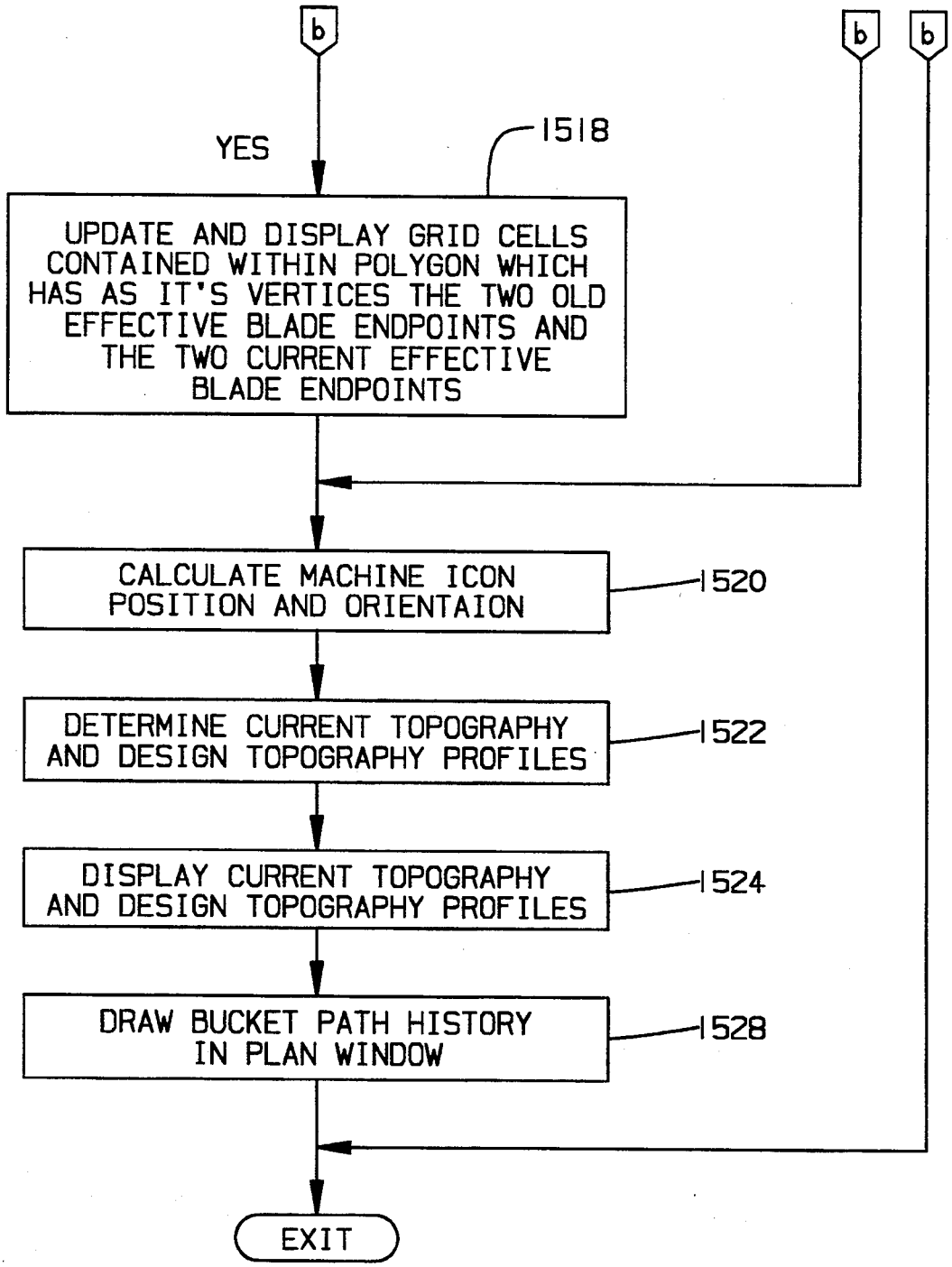

To remedy this problem, in FIGS. 15*a–c* a subroutine determines the path of the operative portion of the bucket 108 relative to the site plan grid. At step 1502 in FIG. 15*a*, the module determines whether the machine-mounted receiver position has changed latitudinally or longitudinally (in the x or y directions in an [x, y, z] coordinate system) relative to the site. If yes, the system at step 1504 determines whether this is the first system loop. If the present loop is not the first loop, the machine/bucket path determined and displayed from the previous loops is erased at step 1506 for updating in the present loop. If the present loop is the first loop, step 1506 is simply bypassed, as there is no machine path history to erase.

At step 1508 the mining shovel 102 and bucket 108 are initially drawn. If already drawn, the mining shovel 102 and bucket 108 are erased from the previous position on the site model plan at step 1510. At step 1512 the system determines whether the bucket center's current position coordinates are outside the grid element occupied in the last system loop.

If at step 1512 the position of the machine has not changed, for example if the shovel is parked or idling, the system proceeds to steps 1520–1528.

If at step 1512 the position of the machine relative to the site plan grid has changed, the system proceeds to step 1514 where it designates "effective" bucket ends inboard from the actual bucket ends. In the illustrated embodiment the effective bucket ends are recognized by the differencing algorithm as inboard from the actual ends a distance approximately one half the width of a grid element. For example, if the actual bucket 108 is 10.0 feet long, corresponding to five 2.0 ft.×2.0 ft grid elements, the effective locations of the bucket ends are calculated at step 1514 one foot inboard from each actual end. If the effective (non-actual) bucket ends contact or pass over any portion of a grid element on the digitized site model, that grid element is read and manipulated by the differencing algorithm as having been excavated, since in actuality at least one half of that grid element was actually passed over by the bucket. Of course, the amount of bucket end offset can vary depending on the size of the grid elements and the desired margin of error in determining whether the bucket has excavated a grid element. For example, it is possible to set the effective tool parameters equal to the actual tool parameters, although the smaller effective parameters of the illustrated embodiment are preferred.

At step 1516 the system determines whether the bucket has moved since the last system loop. If the bucket has moved, the system proceeds to step 1518 to determine the real-time path of the bucket over the site plan grid in a manner described in further detail below with reference to FIG. 16. If at step 1516 the bucket has not moved since the last system loop, the system bypasses step 1518. At step 1520 the system uses the above-determined receiver path information to calculate the machine icon position and orientation. At step 1522 this information is used to determine the current or actual site geography and the desired site geography profiles. At step 1524 these images are displayed on the operator interface 830 in either the bench screen or the ore screen. At step 1528 the system next draws the mining shovel and bucket on the operator interface 830 to reflect the most recent machine movement and site alterations in the path of the bucket.

Referring back to step 1502 of the subroutine, if there has been no significant change in the bucket's position since the last measurement, the bucket position, tracking and updating steps 1504–1528 are bypassed.

The option is available to the operator to stop the system as described above, for example at the end of the day or at lunchtime. If the operator chooses to stop the system, the system stores the current database in a file on a suitable digital storage medium in the system computer, for example, a permanent or removable disk. The operations of the differencing module are terminated, and the operator is returned to the computer operating system. If the operator does not quit the system, it returns to take subsequent position readings from the serial port connected to position module 804, and the system loop repeats itself.

Figure 16A:
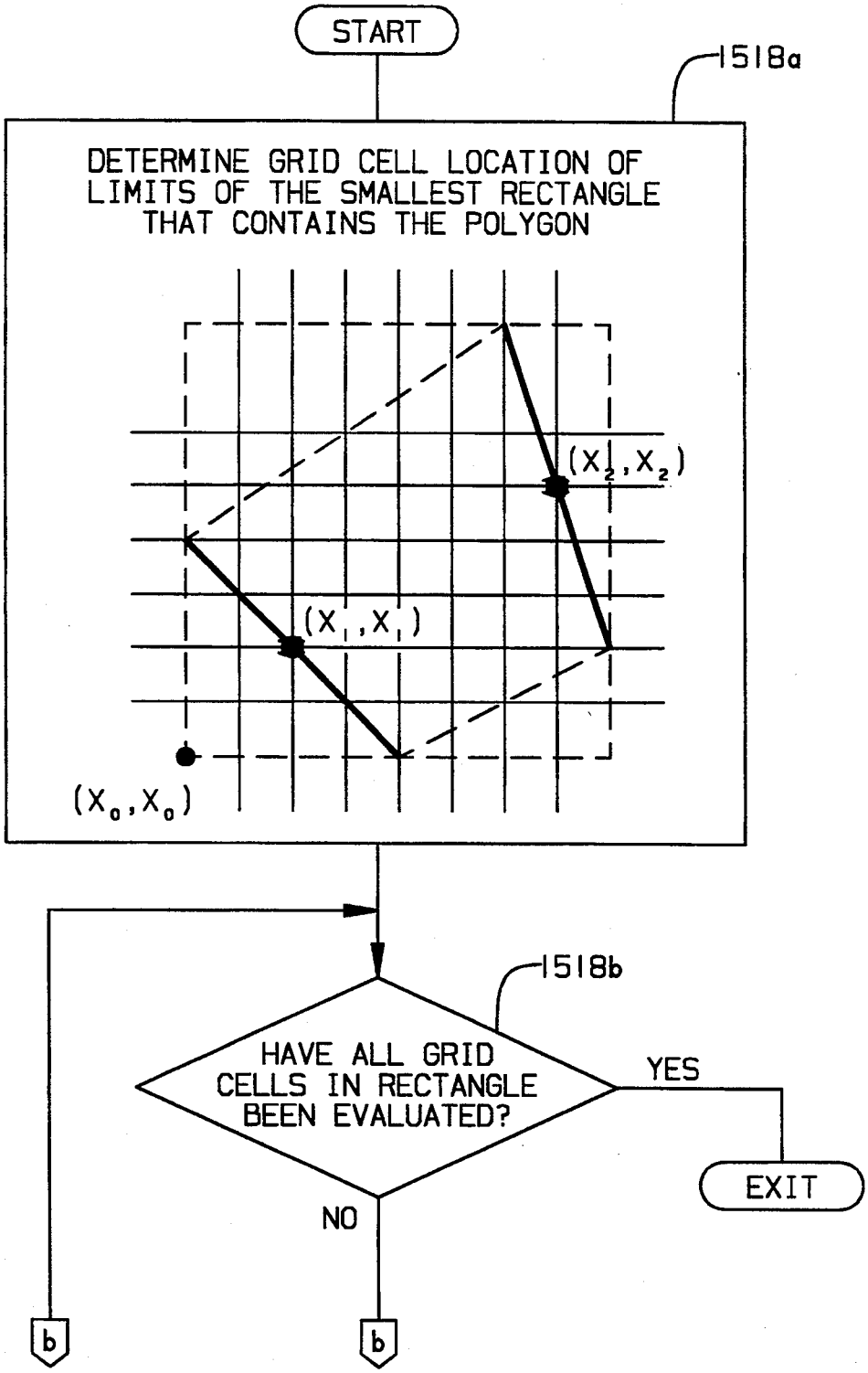
FIGS. 16*a* and 16*b* illustrate a flow chart of an algorithm used in an embodiment of the invention.
Figure 16B:
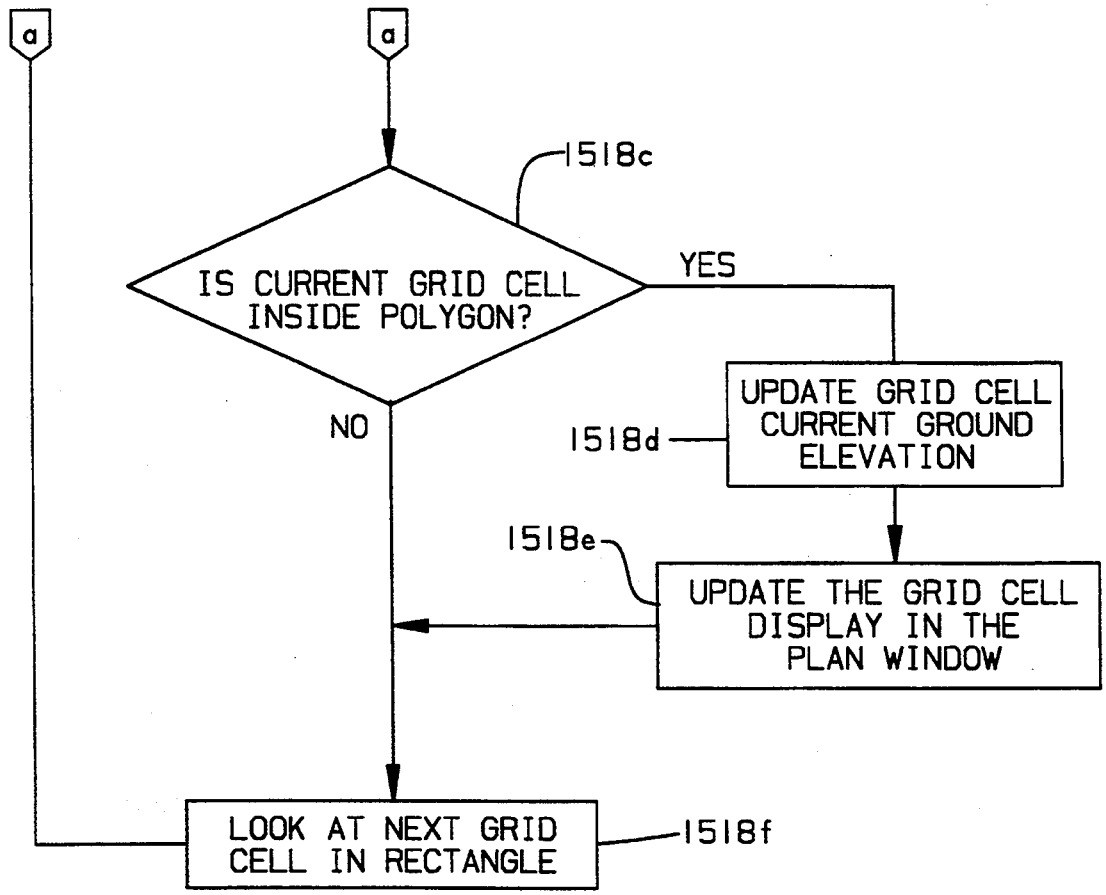

The subroutine for step 1518 in FIG. 15*c* which updates the bucket path and current site plan is shown in further detail in FIGS. 16*a–b*. While the algorithm of step 1514 compensates for the lack of complete correspondence between the width of the machine or tool and the number of grid elements completely traversed by the machine or tool, the distance and direction changes which the machine/tool makes between GPS position readings results in a loss of real time update information over a portion of the machine's travel. This is particularly acute where implement travel speed is high relative to the grid elements of the site plan. For example, where the grid elements are one meter square and the sampling rate of the position system is one coordinate sample per second, an implement traveling at 18 kilometers per hour travels approximately five meters or five grid squares between position samplings. Accordingly, there is no real time information with respect to at least the intermediate three of the five grid squares covered by the machine.

To solve this problem a "fill in the polygon" algorithm is used in step 1518 to estimate the path traversed by the bucket 108 between coordinate samplings. In FIG. 16, the algorithm at step 1518*a* locates a rectangle on the site plan grid surface defined by the effective ends of the bucket 108 at positions $(x_1, y_1)$ and $(x_2, y_2)$ and coordinate position $(x_0, y_0)$. At steps 1518*b*, 1518*c* and 1518*f* a search algorithm searches within the rectangle's borders for those grid elements within a polygon defined between the two bucket positions; i.e., those grid elements traversed by the bucket between its effective ends.

At steps 1518*d* and 1518*e* these recently-traversed grid elements are "painted", shaded, marked or otherwise updated to inform the operator that these grid elements have been excavated. In step 1518*d* the ground elevation or z-axis coordinate of the grid elements is updated at coordinate $(x_2, y_2)$. In step 1518*e*, the bench screen is updated such that a current elevation greater than the target elevation results in the grid elements being, for example, colored red. A current elevation equal to the target elevation results in the grid elements being, for example, colored yellow. A current elevation less than the target elevation results in the grid elements being, for example, colored blue. On the operator interface 830 the update appears as the just-traversed swath of grid elements behind the bucket, colored or otherwise visually updated.

While the system and method of the illustrated embodiment of FIG. 15*a–c* and 16*a–b* are directed to providing real time machine position and site update information via a visual operator display, it will be understood by those skilled in the art that the signals generated which represent the machine position and site update information can be used in a non-visual manner to operate known automatic machine controls.

INDUSTRIAL APPLICABILITY

In operation the present invention provides a simple system for determining the location and orientation of the mining shovel 106 and bucket 108. with minimal instrumentation on the shovel. In particular, a single GPS receiver 202 is used to provide all of the relevant shovel and bucket location information. The system also displays the shovel and bucket location in the work site with bench elevation and ore locations also indicated to provide a visual indication of the work to be performed without the need for stakes, flags, or other surface markers. The operator can therefore monitor the bucket location during actual operation relative to any established boundaries such as ore/waste boundaries and/or property boundaries. Records are also maintained of the material excavated by determining the location of the shovel including the bucket relative to the material. Advantageously, the GPS antenna is located far enough away from the material being loaded into the bucket and far enough away from any moving shovel parts that the antenna will not be subjected to damage.

The illustrated embodiments provide an understanding of the broad principles of the invention, and disclose in detail a preferred application, and are not intended to be limiting. Many other modifications or applications of the invention can be made and still lie within the scope of the appended claims.

Other aspects, objects, and advantages of this invention can be obtained from a study of the drawings, the disclosure, and the appended claims.

We claim:

1. An apparatus for determining the location of a digging implement at a work site, comprising:

an undercarriage;

a car body rotatably connected to said undercarriage;

a boom connected to said car body;

a stick connected to said boom;

a work implement connected to said stick;

means for rotating said car body; and a positioning system including a receiver connected to said stick and a processing means for determining the location of said receiver in three dimensional space at a plurality of points as said car body is rotated and for determining the location and orientation of said work implement in response to the location of said plurality of points.

2. An apparatus, as set forth in claim 1, wherein said processing means includes means for determining the center and radius of rotation of said receiver as said car body rotates and the height of the plane of rotation of said receiver above the ground.

3. An apparatus, as set forth in claim 1, wherein said stick is pivotally and slidably connected to said boom.

4. An apparatus, as set forth in claim 1, including a storage device in which a site survey of the work site is stored; and display means for indicating the location of said work implement in the work site.

5. An apparatus, as set forth in claim 4, wherein said display means includes means for displaying ore locations and overburden locations at the work site.

6. An apparatus, as set forth in claim 4, wherein said display means includes means for displaying areas that remain to be excavated and areas that have been excavated.

7. An apparatus, as set forth in claim 4, wherein said display means includes means for indicating bench slope and elevation.

8. An apparatus, as set forth in claim 1, including means for determining when said work implement is being loaded.

9. An apparatus, as set forth in claim 1, wherein said receiver is located substantially on a centerline extending through said stick in a plane substantially perpendicular to the plane of rotation of said car body.

10. An apparatus, as set forth in claim 1, where wherein said receiver is substantially displaced laterally from a centerline extending through said stick in a plane being substantially perpendicular to the plane of rotation of said car body.

11. An apparatus for determining the location of a digging implement at a work site, comprising:

an undercarriage;

a car body rotatably connected to said undercarriage;

a boom connected to said car body;

a stick connected to said boom;

a work implement connected to said stick;

means for rotating said car body;

a positioning system including a receiver connected to said stick;

an initialization means for determining the location and orientation of said car body when the undercarriage has been moved, said initialization means including a processing means for determining the location of said receiver in three dimensional space at a plurality of points as said car body is rotated and determining the location and orientation of said work implement in response to the location of said plurality of points; and means for tracking the location of said work implement throughout a work cycle in response to the location of said receiver.

12. An apparatus, as set forth in claim 11, including means for tracking the location of the digging implement as the undercarriage is moved.

13. An apparatus, as set forth in claim 11, wherein said stick is rotatably and slidably connected to said boom.

14. An apparatus, as set forth in claim 11, wherein said stick is at a known point of extension during initialization.

15. An apparatus for determining the location of a digging implement at a work site, comprising:

an undercarriage;

a car body rotatably connected to said undercarriage;

a boom connected to said car body;

a stick connected to said boom;

a work implement connected to said stick;

means for rotating said car body;

means for applying force to said work implement;

means for sensing power being delivered to said work implement and responsively producing a digging signal;

a positioning system including a receiver connected to said stick and a processing means for determining the location of said receiver in three dimensional space at a plurality of points;

means for determining the location of said work implement in response to the location of said plurality of points; and means for determining the location of material being excavated from the work site in response to said digging signal and the location of said work implement.

16. An apparatus, as set forth in claim 15, including a storage device in which a site survey of the work site is stored; and display means for indicating the location of said work implement in the work site.

17. An apparatus, as set forth in claim 16, wherein said display means includes means for displaying ore locations and overburden locations at the work site.

18. An apparatus, as set forth in claim 16, wherein said display means includes means for displaying areas that remain to be excavated and areas that have been excavated.

19. An apparatus, as set forth in claim 16, wherein said display means includes means for indicating bench slope and elevation.

20. An apparatus, as set forth in claim 15, including means for determining when said work implement is being loaded.

21. A method for determining the location of a mining shovel at a work site, the mining shovel including an undercarriage, a car body rotatably connected to the undercarriage, a boom connected to the car body, a stick connected to the boom, and a work implement connected to the stick, comprising the steps of:

rotating the car body;

receiving signals from an external reference source;

determining the position of a point on the stick in response to the received signals;

determining the location of the point on the stick in three dimensional space at a plurality of points as said car body is rotated; and determining the location and orientation of the work implement in response to the location of the plurality of points.

22. A method, as set forth in claim 21, including the steps of determining the center and radius of rotation of said receiver as said car body rotates and the height of the plane of rotation of said receiver above the ground.

23. A method, as set forth in claim 21, including the step of displaying the location of the work implement in the work site.

24. A method, as set forth in claim 23, including the step of displaying ore locations and overburden locations at the work site.

25. A method, as set forth in claim 23, including the step of displaying areas that remain to be excavated and areas that have been excavated.

26. A method, as set forth in claim 21, including the step of determining when the work implement is being loaded.

27. A method for determining the location of a mining shovel at a work site, the mining shovel including an undercarriage, a car body rotatably connected to the undercarriage, a boom connected to the car body, a stick connected to the boom, and a work implement connected to the stick, comprising the steps of:

rotating the car body;

receiving signals from an external reference source;

determining the position of a point on the stick in response to the received signals;

initializing the determining the location and orientation of the car body after the undercarriage has been moved, said initializing step including the steps of determining the location of said point on the stick in three dimensional space at a plurality of points as said car body is rotated and determining the location and orientation of the work implement in response to the location of the plurality of points; and tracking the location of the work implement throughout a work cycle in response to the location of the point on the stick.

28. A method, as set forth in claim 27, including the step of tracking the location of the digging implement as the undercarriage is moved.

29. A method for determining the location of a mining shovel at a work site, the mining shovel including an undercarriage, a car body rotatably connected to the undercarriage, a boom connected to the car body, a stick connected to the boom, and a work implement connected to the stick, comprising the steps of:

rotating the car body;

receiving signals from an external reference source;

determining the position of a point on the stick in response to the received signals;

determining the location of the point on the stick in three dimensional space at a plurality of points as said car body is rotated; and determining the location of the work implement in response to the location of the plurality of points.

applying force to the work implement;

sensing the amount of power being delivered to the work implement and responsively producing a digging signal; and determining the location of material being excavated from the work site in response to the digging signal and the location of the work implement.

30. A method, as set forth in claim 29, including the step of displaying the location of the work implement in the work site.

31. A method, as set forth in claim 30, including the step of displaying ore locations and overburden locations at the work site.

32. A method, as set forth in claim 30, including the step of displaying areas that remain to be excavated and areas that have been excavated.

33. A method, as set forth in claim 30, including the step of indicating bench slope and elevation.

34. A method, as set forth in claim 29, the step of determining when said work implement is being loaded.

* * * * *